US011620939B2

(12) United States Patent
Yue et al.

(10) Patent No.: US 11,620,939 B2
(45) Date of Patent: Apr. 4, 2023

(54) PIXEL DRIVING CIRCUIT AND DRIVING METHOD THEREFOR, DISPLAY PANEL, AND DISPLAY APPARATUS

(71) Applicant: BOE TECHNOLOGY GROUP CO., LTD., Beijing (CN)

(72) Inventors: Han Yue, Beijing (CN); Can Zhang, Beijing (CN); Minghua Xuan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/609,238

(22) PCT Filed: Oct. 27, 2020

(86) PCT No.: PCT/CN2020/124069
§ 371 (c)(1),
(2) Date: Nov. 5, 2021

(87) PCT Pub. No.: WO2021/083155
PCT Pub. Date: May 6, 2021

(65) Prior Publication Data

US 2022/0215795 A1 Jul. 7, 2022

(30) Foreign Application Priority Data

Oct. 30, 2019 (CN) ..... 201911047859.7

(51) Int. Cl.
*G09G 3/32* (2016.01)
*G09G 3/20* (2006.01)

(52) U.S. Cl.
CPC ..... *G09G 3/32* (2013.01); *G09G 3/2074* (2013.01); *G09G 2300/0819* (2013.01);
(Continued)

(58) Field of Classification Search
CPC ..... G09G 3/32; G09G 3/2074; G09G 2300/0819; G09G 2310/08;
(Continued)

(56) References Cited

U.S. PATENT DOCUMENTS

2010/0321367 A1* 12/2010 Shona ..... G09G 3/3275 345/211
2018/0075798 A1* 3/2018 Nho ..... G09G 3/32
(Continued)

*Primary Examiner* — Andrew Sasinowski
(74) *Attorney, Agent, or Firm* — IP & T Group LLP

(57) ABSTRACT

A pixel driving circuit includes: a driving control sub-circuit configured to write at least a first data signal into a first driving sub-circuit in response to a first scanning signal and cause a driving transistor to output a driving signal to an element to be driven according to the first data signal and a first power supply voltage signal in response to an enable signal, and a time control sub-circuit configured to write at least a second data signal into a second driving sub-circuit in response to a second scanning signal and cause the second driving sub-circuit to be connected to a second power supply voltage signal terminal and the element in response to the enable signal. The second driving sub-circuit is configured to output a second power supply voltage signal to the element in response to the second data signal and a common voltage signal.

20 Claims, 10 Drawing Sheets

(52) U.S. Cl.
CPC . *G09G 2310/08* (2013.01); *G09G 2320/0233* (2013.01); *G09G 2320/0271* (2013.01)

(58) Field of Classification Search
CPC ... G09G 2320/0233; G09G 2320/0271; G09G 2300/0871; G09G 2320/0204; G09G 3/3233; G09G 3/3208
See application file for complete search history.

(56) References Cited

U.S. PATENT DOCUMENTS

| | | | | |
|---|---|---|---|---|
| 2019/0025965 | A1* | 1/2019 | Yang | G09G 3/32 |
| 2019/0066620 | A1* | 2/2019 | Park | G09G 3/3611 |
| 2019/0347990 | A1* | 11/2019 | Knez | G09G 3/2022 |

* cited by examiner

PIXEL DRIVING CIRCUIT AND DRIVING METHOD THEREFOR, DISPLAY PANEL, AND DISPLAY APPARATUS

CROSS-REFERENCE TO RELATED APPLICATIONS

This application is a national phase entry under 35 USC 371 of International Patent Application No. PCT/CN2020/124069, filed on Oct. 27, 2020, which claims priority to Chinese Patent Application No. 201911047859.7, filed on Oct. 30, 2019, which are incorporated herein by reference in their entirety.

TECHNICAL FIELD

The present disclosure relates to the field of display technologies, and in particular, to a pixel driving circuit and a driving method therefor, a display panel and a display apparatus.

BACKGROUND

Self-luminous devices have attracted much attention due to their characteristics of a high brightness and a wide color gamut. However, due to the uniformity of the fabrication process, turn-on voltages of the self-luminous devices are not consistent. Moreover, the photoelectric conversion properties (including the photoelectric conversion efficiency, uniformity and chromaticity coordinates, etc.) of the self-luminous device will vary with the change of the current flowing through the self-luminous device. Therefore, in a case where the self-luminous device is applied to a display panel, it will have a certain effect on a display effect of the display panel.

SUMMARY

In an aspect, a pixel driving circuit is provided. The pixel driving circuit includes a driving control sub-circuit and a time control sub-circuit. The driving control sub-circuit is connected to at least a first scanning signal terminal, a first data signal terminal, a first power supply voltage signal terminal, an enable signal terminal and a first electrode of a element to be driven. The driving control sub-circuit includes a first driving sub-circuit, and the first driving sub-circuit includes a driving transistor. The driving control sub-circuit is configured to write a at least first data signal from the first data signal terminal into the first driving sub-circuit in response to a first scanning signal received from the first scanning signal terminal, and cause the driving transistor to output a driving signal to the first electrode of the element to be driven according to the first data signal and a first power supply voltage signal from the first power supply voltage signal terminal in response to an enable signal received from the enable signal terminal.

The time control sub-circuit is connected to at least a second scanning signal terminal, a second data signal terminal, a second power supply voltage signal terminal, the enable signal terminal, a common voltage signal terminal, and a second electrode of the element to be driven. The time control sub-circuit includes a second driving sub-circuit. The time control sub-circuit is configured to write at least a second data signal from the second data signal terminal into the second driving sub-circuit in response to a second scanning signal received from the second scanning signal terminal, and cause the second driving sub-circuit to be connected to the second power supply voltage signal terminal and the second electrode of the element to be driven in response to the enable signal received from the enable signal terminal. The second driving sub-circuit is configured to output a second power supply voltage signal from the second power supply voltage signal terminal to the second electrode of the element to be driven in response to the second data signal and a common voltage signal that varies within a set voltage range received from the common voltage signal terminal, so that the element to be driven operates in response to the received driving signal and the second power supply voltage signal.

In some embodiments, the first driving sub-circuit further includes a first capacitor. A first electrode of the first capacitor is connected to the first power supply voltage signal terminal, and a second electrode of the first capacitor is connected to a first node. A gate of the driving transistor is connected to the first node.

In some embodiments, the driving control sub-circuit further includes a first data writing sub-circuit and a first control sub-circuit. The first data writing sub-circuit is connected to the first scanning signal terminal, the first data signal terminal, the first node, and the driving transistor. The first data writing sub-circuit is configured to write the first data signal and a threshold voltage of the driving transistor into the first node in response to the received first scanning signal. The first control sub-circuit is connected to the enable signal terminal, the first power supply voltage signal terminal, the driving transistor and the first electrode of the element to be driven. The first control sub-circuit is configured to connect the driving transistor to the first power supply voltage signal terminal and the first electrode of the element to be driven in response to the received enable signal.

In some embodiments, the first data writing sub-circuit includes a second transistor and a third transistor. A gate of the second transistor is connected to the first scanning signal terminal, a first electrode of the second transistor is connected to a second electrode of the driving transistor, and a second electrode of the second transistor is connected to the first node. A gate of the third transistor is connected to the first scanning signal terminal, a first electrode of the third transistor is connected to the first data signal terminal, and a second electrode of the third transistor is connected to a first electrode of the driving transistor.

In some embodiments, the first control sub-circuit includes a fourth transistor and a fifth transistor. A gate of the fourth transistor is connected to the enable signal terminal, a first electrode of the fourth transistor is connected to the first power supply voltage signal terminal, and a second electrode of the fourth transistor is connected to a first electrode of the driving transistor. A gate of the fifth transistor is connected to the enable signal terminal, a first electrode of the fifth transistor is connected to the second electrode of the driving transistor, and a second electrode of the fifth transistor is connected to the first electrode of the element to be driven.

In some embodiments, the driving control sub-circuit further includes a first reset sub-circuit. The first reset sub-circuit is connected to a first initial signal terminal, a first reset signal terminal and a gate of the driving transistor. The first reset sub-circuit is configured to transmit a first initial signal from the first initial signal terminal to the gate of the driving transistor in response to a first reset signal received from the first reset signal terminal, so as to reset a voltage of the gate of the driving transistor.

In some embodiments, the first reset sub-circuit includes a sixth transistor. A gate of the sixth transistor is connected to the first reset signal terminal, a first electrode of the sixth transistor is connected to the first initial signal terminal, and a second electrode of the sixth transistor is connected to the gate of the driving transistor.

In some embodiments, the second driving sub-circuit includes a first transistor and a second capacitor. A first electrode of the second capacitor is connected to a second node, and a second electrode of the second capacitor is connected to the common voltage signal terminal. A gate of the first transistor is connected to the second node. The first transistor is configured to be turned on in response to the common voltage signal that varies within the set voltage range received from the common voltage signal terminal and the second data signal.

In some embodiments, the time control sub-circuit further includes a second data writing sub-circuit and a second control sub-circuit. The second data writing sub-circuit is connected to the second scanning signal terminal, the second data signal terminal, the second node, and a first electrode and a second electrode of the first transistor. The second data writing sub-circuit is configured to write the second data signal and a threshold voltage of the first transistor into the second node in response to the received second scanning signal. The second control sub-circuit is connected to the enable signal terminal, the second power supply voltage signal terminal, the first electrode and the second electrode of the first transistor, and the second electrode of the element to be driven. The second control sub-circuit is configured to connect the first transistor to the second power supply voltage signal terminal and the second electrode of the element to be driven in response to the received enable signal.

In some embodiments, the second data writing sub-circuit includes a seventh transistor and an eighth transistor. A gate of the seventh transistor is connected to the second scanning signal terminal, a first electrode of the seventh transistor is connected to the second data signal terminal, and a second electrode of the seventh transistor is connected to the first electrode of the first transistor. A gate of the eighth transistor is connected to the second scanning signal terminal, a first electrode of the eighth transistor is connected to the second electrode of the first transistor, and a second electrode of the eighth transistor is connected to the second node.

In some embodiments, the second control sub-circuit includes a ninth transistor and a tenth transistor. A gate of the ninth transistor is connected to the enable signal terminal, a first electrode of the ninth transistor is connected to the second power supply voltage signal terminal, and a second electrode of the ninth transistor is connected to the first electrode of the first transistor. A gate of the tenth transistor is connected to the enable signal terminal, a second electrode of the tenth transistor is connected to the second electrode of the element to be driven, and a first electrode of the tenth transistor is connected to the second electrode of the first transistor.

In some embodiments, the first transistor is an N-type transistor, and the driving transistor is a P-type transistor; or, the first transistor is a P-type transistor, and the driving transistor is an N-type transistor.

In some embodiments, the time control sub-circuit further includes a second reset sub-circuit. The second reset sub-circuit is connected to a second initial signal terminal, a second reset signal terminal and the second node. The second reset sub-circuit is configured to transmit a second initial signal from the second initial signal terminal to the second node in response to a second reset signal received from the second reset signal terminal, so as to reset a voltage of the second node.

In some embodiments, the second reset sub-circuit includes an eleventh transistor. A gate of the eleventh transistor is connected to the second reset signal terminal, a first electrode of the eleventh transistor is connected to the second initial signal terminal, and a second electrode of the eleventh transistor is connected to the second node.

In a second aspect, a display panel is provided. The display panel includes a plurality of pixel driving circuits as described above and a plurality of elements to be driven. An element to be driven of the plurality of elements to be driven is connected to a corresponding pixel driving circuit.

In some embodiments, the display panel has a plurality of sub-pixel regions. Each pixel driving circuit is disposed in one sub-pixel region. The display panel further includes a plurality of first scanning signal lines, a plurality of first data signal lines, a plurality of second scanning signal lines and a plurality of second data signal lines. First scanning signal terminals connected to pixel driving circuits located in the same row of sub-pixel regions are connected to a corresponding first scanning signal line. First data signal terminals connected to pixel driving circuits located in the same column of sub-pixel regions are connected to a corresponding first data signal line. Second scanning signal terminals connected to the pixel driving circuits located in the same row of sub-pixel regions are connected to a corresponding second scanning signal line. Second data signal terminals connected to the pixel driving circuits located in the same column of sub-pixel regions are connected to a corresponding second data signal line.

In some embodiments, the element to be driven is a current mode light-emitting diode.

In a third aspect, a display apparatus is provided. The display apparatus includes the display panel as described above.

In a fourth aspect, a driving method for the pixel driving circuit is provided. A frame period includes a scanning phase and an operating phase. The scanning phase includes a plurality of row scanning periods.

The driving method includes:

in each of the plurality of row scanning periods, writing, by the driving control sub-circuit, at least the first data signal from the first data signal terminal into the first driving sub-circuit, in response to the first scanning signal received from the first scanning signal terminal; and writing, by the time control sub-circuit, at least the second data signal from the second data signal terminal into the second driving sub-circuit, in response to the second scanning signal received from the second scanning signal terminal; and in the operating phase, causing, by the driving control sub-circuit, the driving transistor in the first driving sub-circuit to output the driving signal to the first electrode of the element to be driven according to the first data signal and the first power supply voltage signal from the first power supply voltage signal terminal, in response to the enable signal received from the enable signal terminal; causing, by the time control sub-circuit, the second driving sub-circuit to be connected to the second power supply voltage signal terminal and the second electrode of the element to be driven, in response to the enable signal received from the enable signal terminal; and outputting, by the second driving sub-circuit, the second power supply voltage signal from the second power supply voltage signal terminal to the second electrode of the element to be driven in response to the second data signal and the common voltage signal that varies within the set voltage range received from the common voltage signal terminal, so that the element to be driven operates in response to the received driving signal and the second power supply voltage signal.

In some embodiments, the driving control sub-circuit further includes a first data writing sub-circuit and a first control sub-circuit. In each of the plurality of row scanning periods, writing, by the driving control sub-circuit, at least the first data signal into the first driving sub-circuit in response to the received first scanning signal, and in the operating phase, causing, by the driving control sub-circuit, the driving transistor in the first driving sub-circuit to output the driving signal to the first electrode of the element to be driven according to the first data signal and the first power supply voltage signal in response to the enable signal, includes:

in each of the plurality of row scanning periods, writing, by the first data writing sub-circuit, the first data signal and a threshold voltage of the driving transistor into the first node, in response to the received first scanning signal; and in the operating phase, causing, by the first control sub-circuit, the driving transistor to be connected to the first power supply voltage signal terminal and the first electrode of the element to be driven in response to the received enable signal, so that the driving transistor outputs the driving signal to the first electrode of the element to be driven according to the first data signal and the first power supply voltage signal.

In some embodiments, the time control sub-circuit further includes a second data writing sub-circuit and a second control sub-circuit. In each of the plurality of row scanning periods, writing, by the time control sub-circuit, at least the second data signal into the second driving sub-circuit in response to the received second scanning signal, and in the operating phase, causing, by the time control sub-circuit, the second driving sub-circuit to be connected to the second power supply voltage signal terminal and the second electrode of the element to be driven in response to the received enable signal, includes:

in each of the plurality of row scanning periods, writing, by the second data writing sub-circuit, the second data signal and a threshold voltage of the first transistor into a gate of the first transistor, in response to the received second scanning signal; and in the operating phase, causing, by the second control sub-circuit, the first transistor to be connected to the second power supply voltage signal terminal and the second electrode of the element to be driven, in response to the received enable signal.

BRIEF DESCRIPTION OF THE DRAWINGS

In order to describe technical solutions in the present disclosure more clearly, accompanying drawings to be used in some embodiments of the present disclosure will be introduced briefly below. Obviously, the accompanying drawings to be described below are merely accompanying drawings of some embodiments of the present disclosure, and a person of ordinary skill in the art can obtain other drawings according to these drawings. In addition, the accompanying drawings in the following description can be regarded as schematic diagrams, and are not limitations on actual sizes of products, actual processes of methods and actual timings of signals involved in the embodiments of the present disclosure.

DETAILED DESCRIPTION

Figure 1:
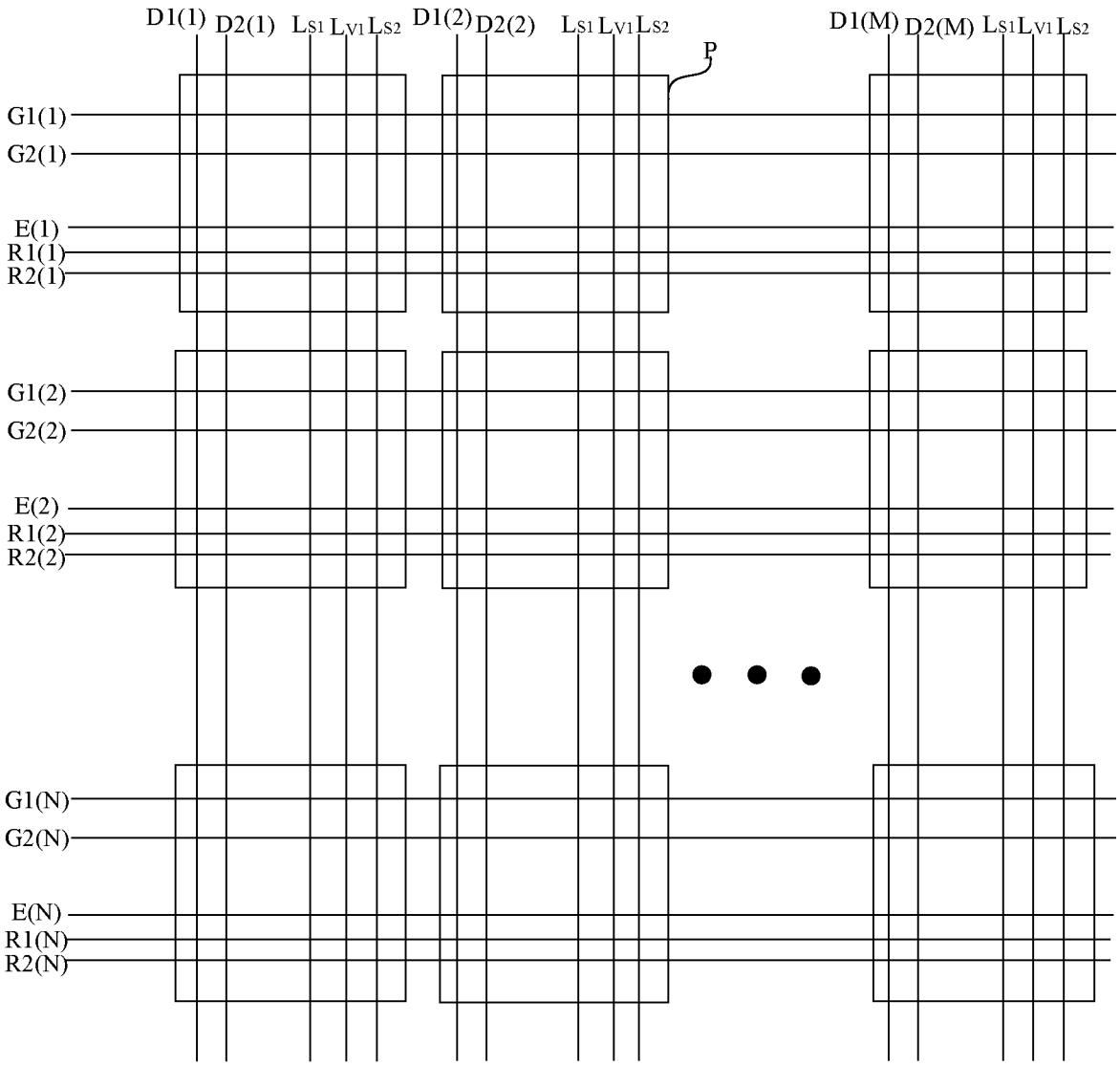
FIG. 1 is a diagram showing a structure of a display panel, in accordance with some embodiments.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, the term "comprise" and other forms thereof such as the third-person singular form "comprises" and the present participle form "comprising" throughout the description and the claims are construed as an open and inclusive meaning, i.e., "including, but not limited to". In the description of the specification, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials, or characteristics described herein may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, a feature defined with "first" or "second" may explicitly or implicitly include one or more of the features. In the description of the embodiments of the present disclosure, the term "a plurality of/the plurality of" means two or more unless otherwise specified.

In the description of some embodiments, the term "connected" and its derivatives may be used. For example, the term "connected" may be used in the description of some embodiments to indicate that two or more components are in direct physical or electrical contact with each other. However, terms such as "connected" may also mean that two or more components are not in direct contact with each other, but still cooperate or interact with each other. The embodiments disclosed herein are not necessarily limited to the contents herein.

In circuits provided in the embodiments of the present disclosure, a first node and a second node do not represent actual components, but represent junctions of related electrical connections in circuit diagrams. That is, these nodes are equivalent to the junctions of related electrical connections in the circuit diagram.

The use of the phrase "configured to" in the description of some embodiments indicates an open and inclusive expression, which does not exclude devices that are configured to perform additional tasks or steps.

Some embodiments of the present disclosure provide a display apparatus, and the display apparatus includes a display panel. As shown in FIG. 1, the display panel has a plurality of sub-pixel regions P.

It will be noted that, FIG. 1 is illustrated by taking an example in which the plurality of sub-pixel regions P are arranged in an array of N rows and M columns, but the embodiments of the present disclosure are not limited thereto, and the plurality of sub-pixel regions P may also be arranged in other manners.

In some embodiments, the display apparatus is a product with a display function such as a television, a mobile phone, a tablet computer, a notebook computer, a display, a digital photo frame or a navigator, which is not limited in the embodiments of the present disclosure.

In some embodiments, the display panel includes a plurality of pixel driving circuits and a plurality of elements to be driven. An element to be driven of the plurality of elements to be driven is connected to a corresponding pixel driving circuit.

In some examples, a sub-pixel region P of the display panel is correspondingly provided with one element to be driven and one pixel driving circuit connected thereto, and the pixel driving circuit is configured to drive the element to be driven to operate.

In some embodiments, the element to be driven is a current-driven device.

In some examples, the element to be driven is a current mode light-emitting diode.

For example, the current mode light-emitting diode is a micro light-emitting diode (Micro-LED), a mini light-emitting diode (Mini-LED), or an organic light-emitting diode (OLED).

On this basis, the operation of the element to be driven may be understood as the light emission of the current mode light-emitting diode.

Figure 2:
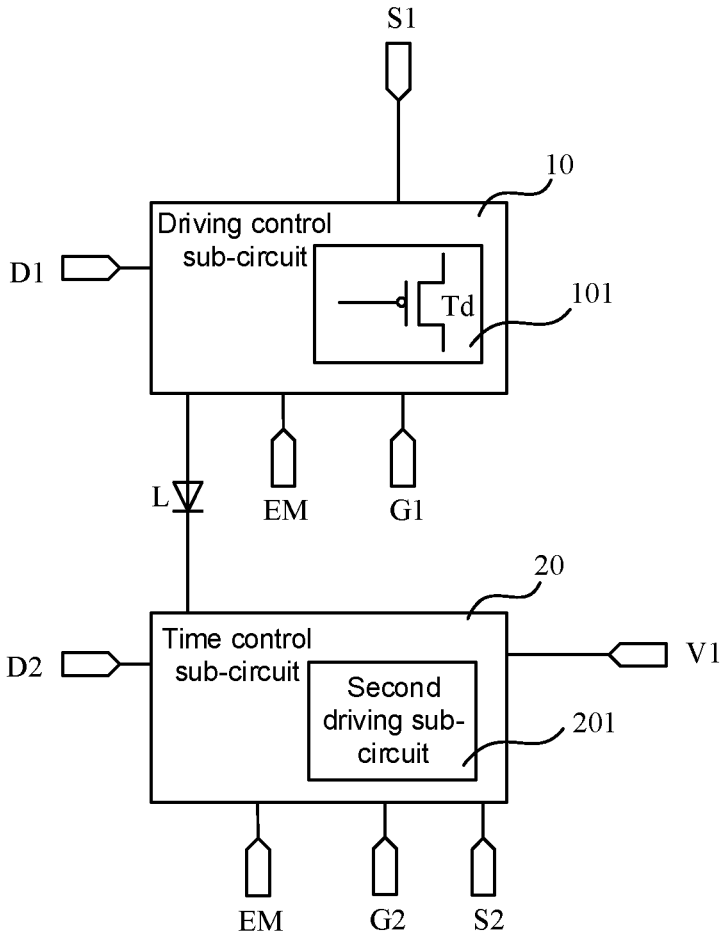
FIG. 2 is a block diagram showing a structure of a pixel driving circuit, in accordance with some embodiments.

As shown in FIG. 2, the pixel driving circuit provided in some embodiments of the present disclosure includes a driving control sub-circuit 10 and a time control sub-circuit 20.

The driving control sub-circuit 10 is connected to at least a first scanning signal terminal G1, a first data signal terminal D1, a first power supply voltage signal terminal S1, an enable signal terminal EM and a first electrode of the element L to be driven. The driving control sub-circuit 10 includes a first driving sub-circuit 101, and the first driving sub-circuit 101 includes a driving transistor Td.

The driving control sub-circuit 10 is configured to: write at least a first data signal from the first data signal terminal D1 into the first driving sub-circuit 101 in response to a first scanning signal received from the first scanning signal terminal G1, and cause the driving transistor Td to output a driving signal to the first electrode of the element L to be driven according to the first data signal from the first data signal terminal D1 and a first power supply voltage signal from the first power supply voltage signal terminal S1 in response to an enable signal received from the enable signal terminal EM.

The time control sub-circuit 20 is connected to at least a second scanning signal terminal G2, a second data signal terminal D2, a second power supply voltage signal terminal S2, the enable signal terminal EM, a common voltage signal terminal V1 and a second electrode of the element L to be driven. The time control sub-circuit 20 includes a second driving sub-circuit 201.

The time control sub-circuit 20 is configured to: write at least a second data signal from the second data signal terminal D2 into the second driving sub-circuit 201 in response to a second scanning signal received from the second scanning signal terminal G2; and cause the second driving sub-circuit 201 to be connected to the second power supply voltage signal terminal S2 and the second electrode of the element L to be driven in response to the enable signal received from the enable signal terminal EM. The second driving sub-circuit 201 is configured to output a second power supply voltage signal from the second power supply voltage signal terminal S2 to the second electrode of the element L to be driven in response to the second data signal received from the second data signal terminal D2 and a common voltage signal that varies within a set voltage range received from the common voltage signal terminal V1, so that the element L to be driven operates in response to the received driving signal and the second power supply voltage signal.

In some embodiments, the driving transistor Td outputting the driving signal to the first electrode of the element L to be driven may be understood as: the driving transistor Td outputting a driving current to a first electrode of the current mode light-emitting diode. The second driving sub-circuit 201 outputting the second power supply voltage signal to the second electrode of the element L to be driven may be understood as: the second driving sub-circuit 201 outputting the second power supply voltage signal to a second electrode of the current mode light-emitting diode. On this basis, the element L to be driven operating in response to the received driving signal and the second power supply voltage signal may be understood as: the current mode light-emitting diode being turned on in response to the driving signal received by the first electrode of the current mode light-emitting diode and the second power supply voltage signal received by the second electrode of the current mode light-emitting diode, and then the current mode light-emitting diode emits light under the driving of the driving current output from the driving transistor Td.

In some embodiments, the first electrode and the second electrode of the element L to be driven are an anode and a cathode of the element L to be driven.

In some examples, the first power supply voltage signal from the first power supply voltage signal terminal S1 is a high-level signal, and the second power supply voltage signal from the second power supply voltage signal terminal S2 is a low-level signal. On this basis, as shown in FIG. 2, the first electrode of the element L to be driven is the anode of the element L to be driven, and the second electrode of the element L to be driven is the cathode of the element L to be driven.

Figure 3:
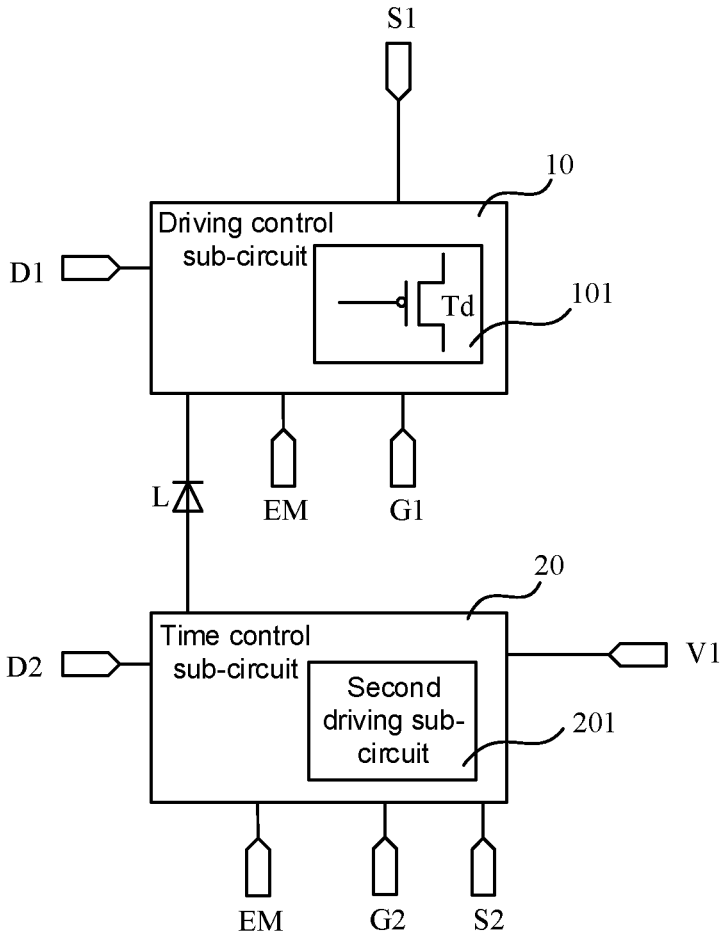
FIG. 3 is a block diagram showing a structure of another pixel driving circuit, in accordance with some embodiments.

In some other examples, the first power supply voltage signal from the first power supply voltage signal terminal S1 is a low-level signal, and the second power supply voltage signal from the second power supply voltage signal terminal S2 is a high-level signal. On this basis, as shown in FIG. 3, the first electrode of the element L to be driven is the cathode of the element L to be driven, and the second electrode of the element L to be driven is the anode of the element L to be driven.

In some examples, the first power supply voltage signal from the first power supply voltage signal terminal S1 and the second power supply voltage signal from the second power supply voltage signal terminal S2 are both constant voltage signals in a frame. Magnitudes of the voltages of the first power supply voltage signal and the second power supply voltage signal may be set by a person skilled in the art in a case of ensuring the normal operation of the pixel driving circuit.

In some examples, the first data signal from the first data signal terminal D1 is a constant high voltage signal, so that the element L to be driven may have a high luminous efficiency. In this case, the pixel driving circuit controls a gray scale displayed by the element L to be driven through the time control sub-circuit 20.

In some other examples, a voltage of the first data signal from the first data signal terminal D1 varies within a certain voltage range, and the first data signal within the voltage range can ensure that the element L to be driven has a high luminous efficiency. In this case, the pixel driving circuit controls a gray scale displayed by the element L to be driven through the driving control sub-circuit 10 and the time control sub-circuit 20.

For the driving control sub-circuit 10, the driving control sub-circuit 10 controls a magnitude of the driving signal (e.g., a magnitude of the driving current) transmitted from the driving transistor Td to the element L to be driven according to voltages of the first data signal from the first data signal terminal D1 and the first power supply voltage signal from the first power supply voltage signal terminal S1. The time control sub-circuit 20 controls duration of the second power supply voltage signal being transmitted to the second electrode of the element L to be driven according to voltages of the second data signal from the second data signal terminal D2 and the common voltage signal from the common voltage signal terminal V1, so as to control operating duration of the element L to be driven. Here, when the second power supply voltage signal is transmitted to the second electrode of the element L to be driven, the element L to be driven is turned on and operates.

In some embodiments, the operating duration of the element L to be driven may be understood as a luminous duration of the current mode light-emitting diode.

In the pixel driving circuit provided in some embodiments of the present disclosure, the driving control sub-circuit 10 writes at least the first data signal from the first data signal terminal D1 into the first driving sub-circuit 101 in response to the first scanning signal received from the first scanning signal terminal G1, and causes the driving transistor Td to output the driving signal to the first electrode of the element L to be driven according to the first data signal from the first data signal terminal D1 and the first power supply voltage signal from the first power supply voltage signal terminal S1 in response to the enable signal received from the enable signal terminal EM. The time control sub-circuit 20 writes the second data signal from the second data signal terminal D2 into the second driving sub-circuit 201 in response to the second scanning signal received from the second scanning signal terminal G2, and causes the second driving sub-circuit 201 to output the second power supply voltage signal from the second power supply voltage signal terminal S2 to the second electrode of the element L to be driven according to the second data signal received from the second data signal terminal D2 and the common voltage signal that varies within the set voltage range received from the common voltage signal terminal V1 in response to the enable signal received from the enable signal terminal EM, so that the element L to be driven operate in response to the received driving signal and the second power supply voltage signal. It can be seen that, the driving control sub-circuit 10 controls the magnitude of the driving signal transmitted to the first electrode of the element to be driven, and the time control sub-circuit 20 controls the duration of the second power supply voltage signal from the second power supply voltage signal terminal S2 being transmitted to the second electrode of the element L to be driven. In this way, when the element L to be driven displays different gray scales, by controlling the magnitude of the driving signal input to the element L to be driven and the operating duration of the element to be driven, it may be possible to achieve a brightness change of the element L to be driven, and further achieve display of a corresponding gray scale.

In a case where the element L to be driven is a current-driven light-emitting device, when the element L to be driven displays a high gray scale, the pixel driving circuit may output a large driving current to the element L to be driven, and may control the luminous duration of the element L to be driven to be long. When the element L to be driven displays a low gray scale, the driving current output by the pixel driving circuit to the element L to be driven may be a large value (e.g., a driving current corresponding to a certain high gray scale), and the brightness of the element L to be driven is reduced by shortening the luminous duration of the element L to be driven. Alternatively, when the element L to be driven displays the low gray scale, the driving current output by the pixel driving circuit to the element L to be driven is maintained within a high value range (e.g., driving currents within the high value range are close to the driving current corresponding the high gray scale being displayed), and the brightness of the element L to be driven is reduced by shortening the luminous duration of the element L to be driven. Therefore, no matter whether the element L to be driven displays a high gray scale or a low gray scale, the driving current is always large, so that the element L to be driven is always at a high current density. As a result, the element L to be driven has a high luminous efficiency, a stable brightness, a lower power consumption, and a good display effect.

Figure 4:
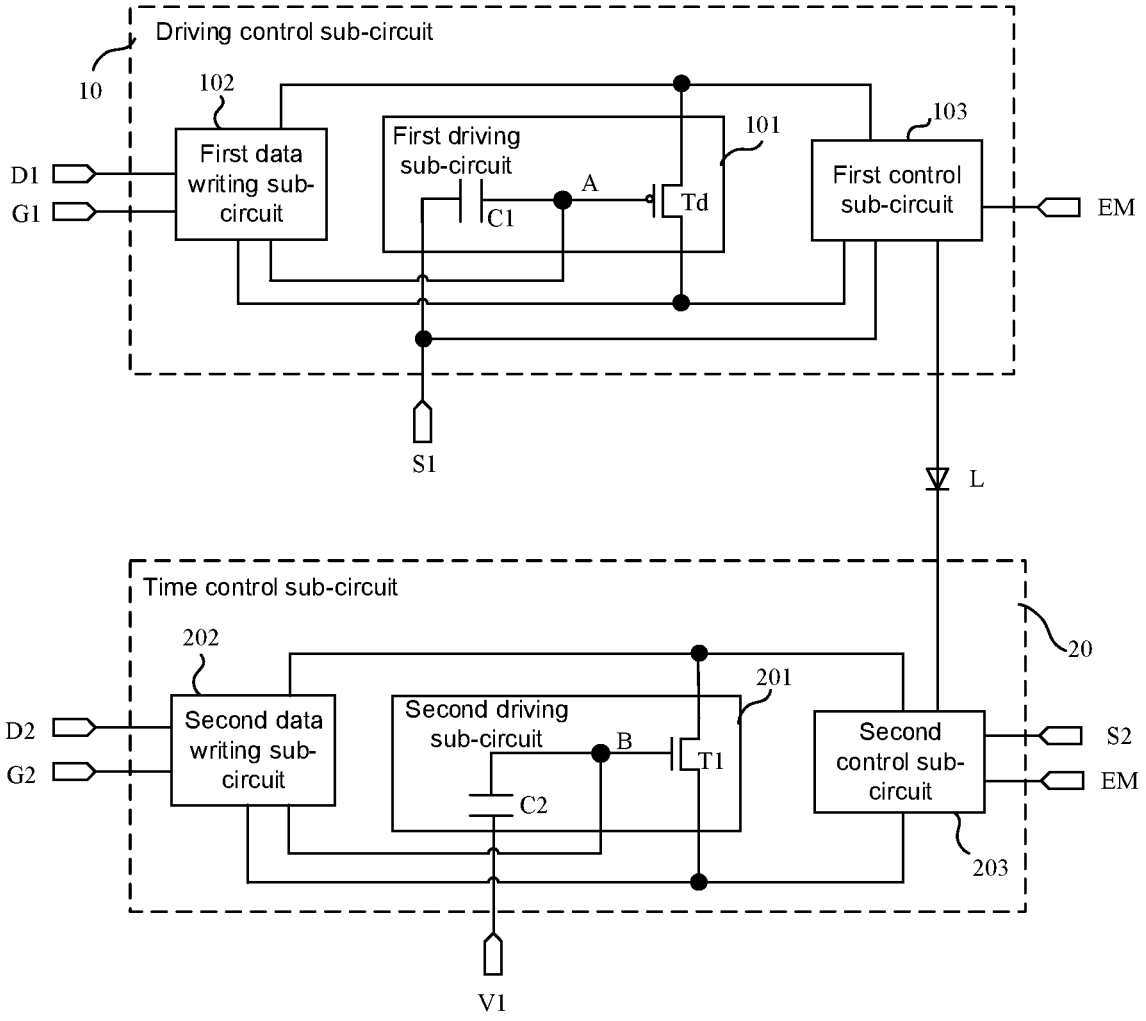
FIG. 4 is a block diagram showing a structure of yet another pixel driving circuit, in accordance with some embodiments.

In some embodiments, as shown in FIG. 4, the first driving sub-circuit 101 includes the driving transistor Td and a first capacitor C1. A first electrode of the first capacitor C1 is connected to the first power supply voltage signal terminal S1, and a second electrode of the first capacitor C1 is connected to a first node A. A gate of the driving transistor Td is connected to the first node A. The driving transistor Td is configured to be turned on in response to the first data signal from the first data signal terminal D1 and the first power supply voltage signal from the first power supply voltage signal terminal S1, and output the driving signal to the first electrode of the element L to be driven.

In some embodiments, as shown in FIG. 4, the driving control sub-circuit 10 further includes a first data writing sub-circuit 102 and a first control sub-circuit 103. The first data writing sub-circuit 102 is connected to the first scanning signal terminal G1, the first data signal terminal D1, the first node A, a first electrode of the driving transistor Td and a second electrode of the driving transistor Td. The first data writing sub-circuit 102 is configured to write the first data signal from the first data signal terminal D1 and a threshold voltage of the driving transistor Td into the first node A in response to the first scanning signal received from the first scanning signal terminal G1, so as to compensate for the threshold voltage of the driving transistor Td.

The first control sub-circuit 103 is connected to the enable signal terminal EM, the first power supply voltage signal terminal S1, the first electrode of the driving to transistor Td, the second electrode of the driving transistor Td, and the first electrode of the element L to be driven. The first control sub-circuit 103 is configured to connect the driving transistor Td to the first power supply voltage signal terminal S1 and the first electrode of the element L to be driven in response to the enable signal received from the enable signal terminal EM.

Figure 5:
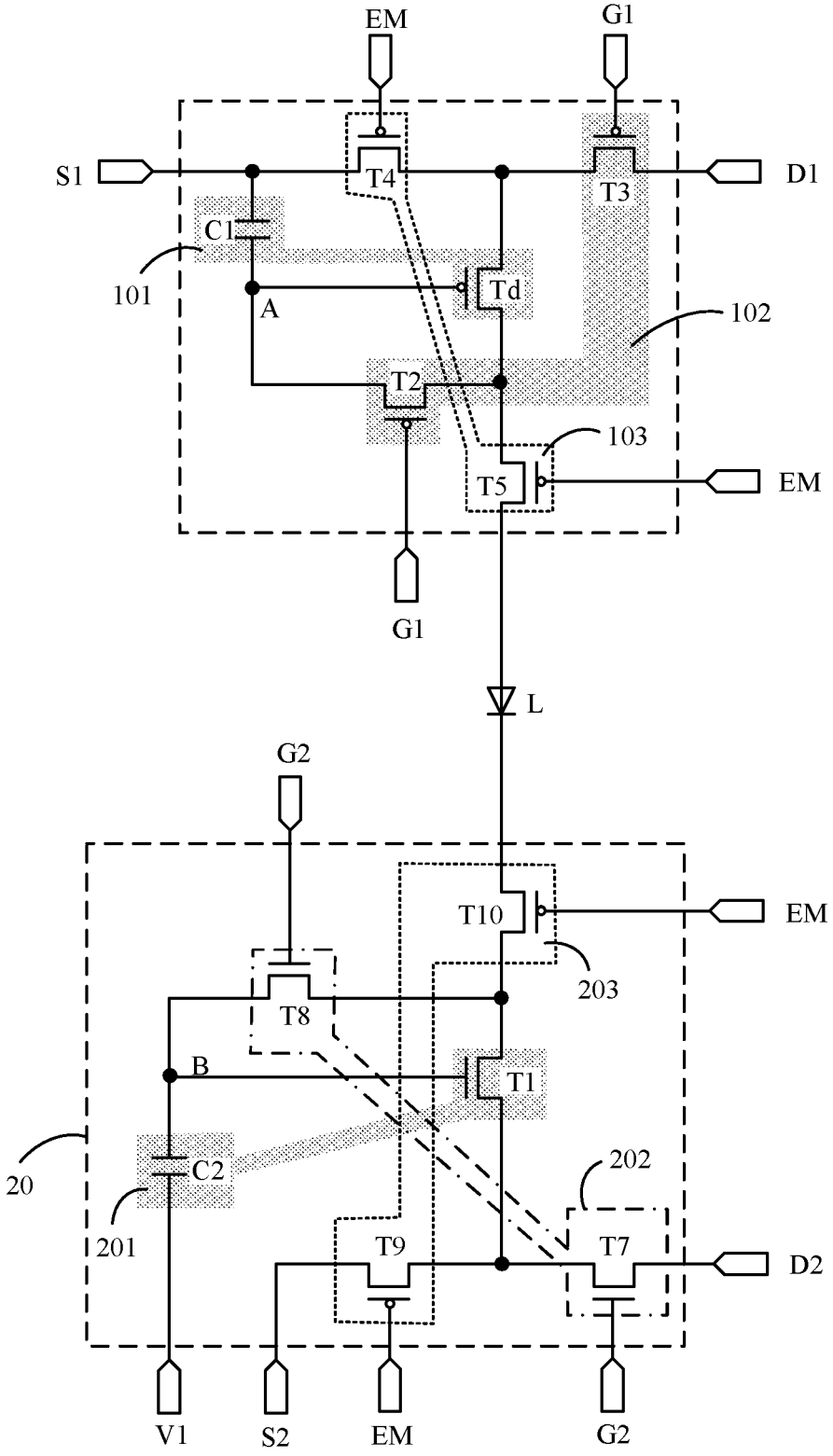
FIG. 5 is a circuit diagram of a pixel driving circuit, in accordance with some embodiments.

In some examples, as shown in FIG. 5, the first data writing sub-circuit 102 includes a second transistor T2 and a third transistor T3. A gate of the second transistor T2 is connected to the first scanning signal terminal G1, a first electrode of the second transistor T2 is connected to the second electrode of the driving transistor Td, and a second electrode of the second transistor T2 is connected to the first node A. A gate of the third transistor T3 is connected to the first scanning signal terminal G1, a first electrode of the third transistor T3 is connected to the first data signal terminal D1, and a second electrode of the third transistor T3 is connected to the first electrode of the driving transistor Td.

In some examples, as shown in FIG. 5, the first control sub-circuit 103 includes a fourth transistor T4 and a fifth transistor T5. A gate of the fourth transistor T4 is connected to the enable signal terminal EM, a first electrode of the fourth transistor T4 is connected to the first power supply voltage signal terminal S1, and a second electrode of the fourth transistor T4 is connected to the first electrode of the driving transistor Td. A gate of the fifth transistor T5 is connected to the enable signal terminal EM, a first electrode of the fifth transistor T5 is connected to the second electrode of the driving transistor Td, and a second electrode of the fifth transistor Td is connected to the first electrode of the element L to be driven.

Figure 6:
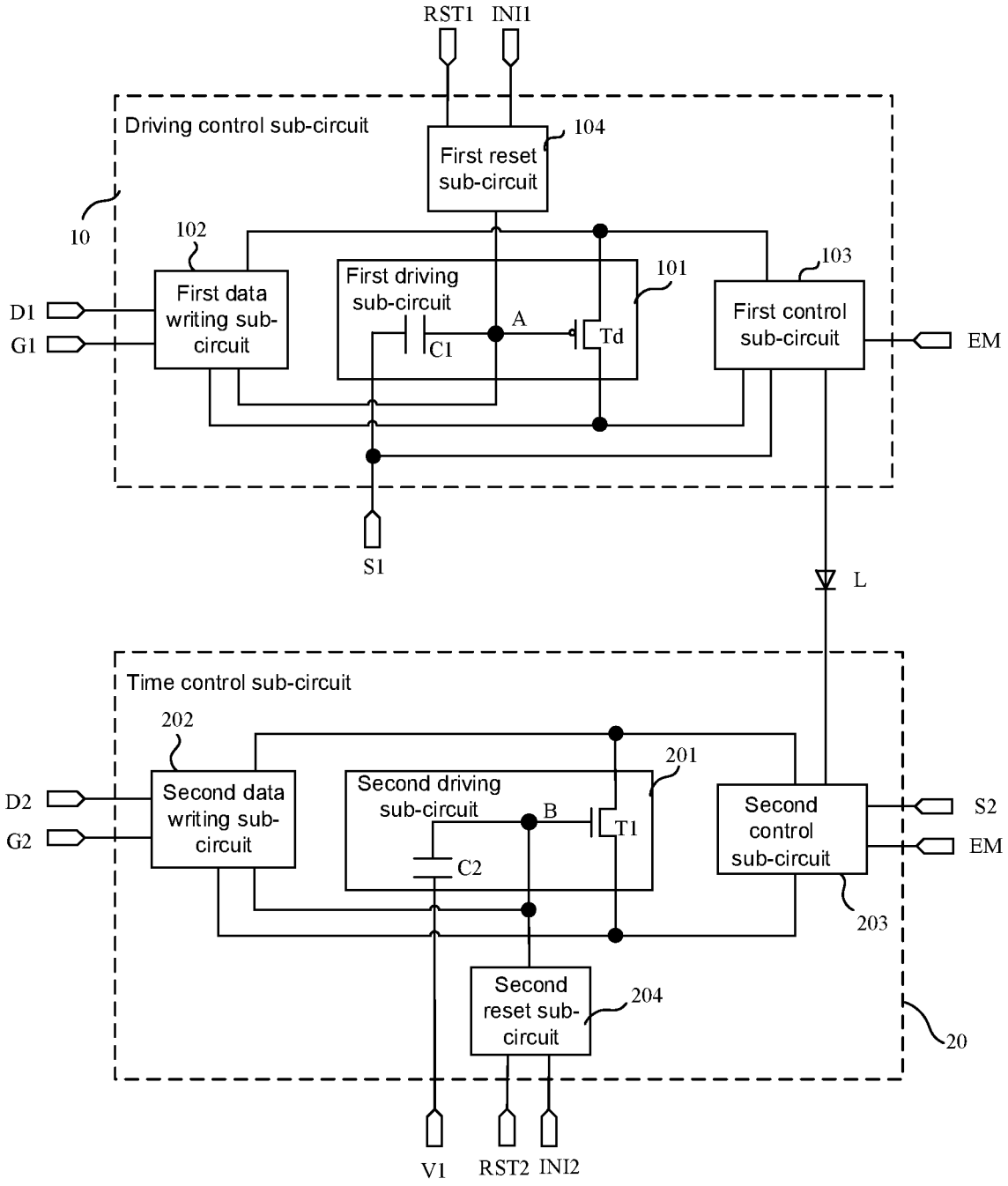
FIG. 6 is a block diagram showing a structure of yet another pixel driving circuit, in accordance with some embodiments.

In some embodiments, as shown in FIG. 6, the driving control sub-circuit 10 further includes a first reset sub-circuit 104. The first reset sub-circuit 104 is connected to a first initial signal terminal INI1, a first reset signal terminal RST1 and the gate of the driving transistor Td. The first reset sub-circuit 104 is configured to transmit a first initial signal from the first initial signal terminal INI1 to the gate of the driving transistor Td in response to a first reset signal received from the first reset signal terminal RST1, so as to reset a voltage of the gate of the driving transistor Td.

Figure 7:
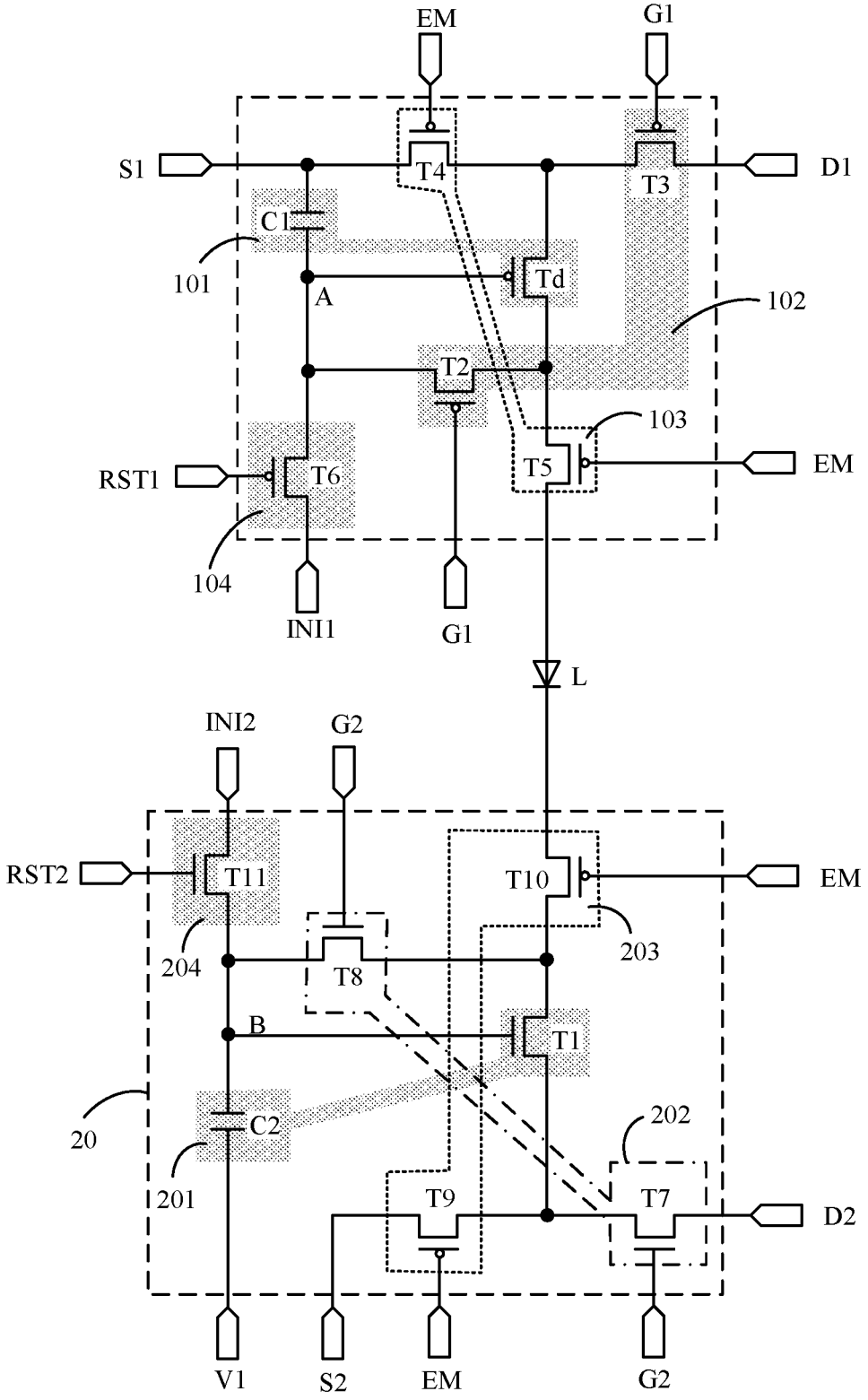
FIG. 7 is a circuit diagram of another pixel driving circuit, in accordance with some embodiments.

In some examples, as shown in FIG. 7, the first reset sub-circuit 104 includes a sixth transistor T6. A gate of the sixth transistor T6 is connected to the first reset signal terminal RST1, a first electrode of the sixth transistor T6 is connected to the first initial signal terminal INI1, and a second electrode of the sixth transistor T6 is connected to the gate of the driving transistor Td.

On this basis, since the second electrode of the first capacitor C1 and the gate of the driving transistor Td are both connected to the first node A, voltages of the second electrode of the first capacitor C1 and the first node A are reset when the first reset sub-circuit 104 resets the voltage of the gate of the driving transistor Td, thereby achieving noise reduction of the first driving sub-circuit 101.

In some embodiments, as shown in FIG. 4, the second driving sub-circuit 201 includes a first transistor T1 and a second capacitor C2. A first electrode of the second capacitor C2 is connected to a second node B, and a second electrode of the second capacitor C2 is connected to the common voltage signal terminal V1. A gate of the first transistor T1 is connected to the second node B. The first transistor T1 is configured to be turned on in response to the common voltage signal that varies within the set voltage range received from the common voltage signal terminal V1 and the second data signal from the second data signal terminal D2.

In some embodiments, the time control sub-circuit 20 further includes a second data writing sub-circuit 202, and a second control sub-circuit 203.

The second data writing sub-circuit 202 is connected to the second scanning signal terminal G2, the second data signal terminal D2, the second node B, and a first electrode and a second electrode of the first transistor T1. The second data writing sub-circuit 202 is configured to write the second data signal from the second data signal terminal D2 and a threshold voltage of the first transistor T1 into the second node B in response to the second scanning signal received from the second scanning signal terminal G2, so as to compensate for the threshold voltage of the first transistor T1.

The second control sub-circuit 203 is connected to the enable signal terminal EM, the second power supply voltage signal terminal S2, the first electrode and the second electrode of the first transistor T1, and the second electrode of the element L to be driven. The second control sub-circuit 203 is configured to connect the first transistor T1 to the second power supply voltage signal terminal S2 and the second electrode of the element L to be driven in response to the enable signal received from the enable signal terminal EM, so that the first transistor T1 is turned on in response to the common voltage signal that varies within the set voltage range received from the common voltage signal terminal V1 and the second data signal from the second data signal terminal D2, and transmits the second power supply voltage signal from the second power supply voltage signal terminal S2 to the second electrode of the element L to be driven. Therefore, the operating duration of the element L to be driven is controlled.

The voltage of the common voltage signal varies with time within the set voltage range, and the set voltage range is determined according to the luminous duration of the element L to be driven. Therefore, by changing the common voltage signal that varies within the set voltage range, it may be possible to control the luminous duration of the element L to be driven, thereby achieving the control of the gray scale.

In the time control sub-circuit provided in some embodiments of the present disclosure, the second data writing sub-circuit 202 writes the second data signal from the second data signal terminal D2 and the threshold voltage of the first transistor T1 into the second node B, so that a voltage of the second node B is a sum of a voltage (denoted as $V_{data2}$) of the second data signal and the threshold voltage (denoted as $V_{th1}$) of the first transistor T1. Since the first electrode of the second capacitor C2 is connected to the second node B, a voltage of the first electrode of the second capacitor C2 is the voltage of the second node B, i.e., ($V_{data2}+V_{th1}$). Moreover, since the second electrode of the second capacitor C2 is connected to the common voltage signal terminal V1, a voltage of the second electrode of the second capacitor C2 is the voltage of the common voltage signal from the common voltage signal terminal V1. According to the law of conservation of charge, a voltage difference of two electrodes of the second capacitor C2 remains unchanged. When the voltage of the common voltage signal varies within the set voltage range, the voltage of the first electrode of the second capacitor C2 varies as the voltage of the common voltage signal varies, that is, the voltage of the second node B varies as the voltage of the common voltage signal varies.

Since the voltage of the common voltage signal varies within the set voltage range, and the gate of the first transistor T1 is connected to the second node B, the first transistor T1 is turned on when the voltage of the second node B varies to a certain value. In this case, the first transistor T1 is connected to the second power supply voltage signal terminal S2 and the second electrode of the element L to be driven, and the second power supply voltage signal from the second power supply voltage signal terminal S2 is transmitted to the second electrode of the element L to be driven through the first transistor T1, so that the element L to be driven operates in response to the driving signal received from the driving transistor Td and the second power supply voltage signal. Whether the first transistor T1 is turned on or not determines whether the second power supply voltage signal is transmitted to the second electrode of the element L to be driven, and thus it may be possible to control the operating duration of the element L to be driven by controlling the first transistor T1 to be turned on or off through the changed common voltage signal.

In some examples, as shown in FIG. 5, the second data writing sub-circuit 202 includes a seventh transistor T7 and an eighth transistor T8. A gate of the seventh transistor T7 is connected to the second scanning signal terminal G2, a first electrode of the seventh transistor T7 is connected to the second data signal terminal D2, and a second electrode of the seventh transistor T7 is connected to the first electrode of the first transistor T1. A gate of the eighth transistor T8 is connected to the second scanning signal terminal G2, a first electrode of the eighth transistor T8 is connected to the second electrode of the first transistor T1, and a second electrode of the eighth transistor T8 is connected to the second node B.

In some examples, as shown in FIG. 5, the second control sub-circuit 203 includes a ninth transistor T9 and a tenth transistor T10. A gate of the ninth transistor T9 is connected to the enable signal terminal EM, a first electrode of the ninth transistor T9 is connected to the second power supply voltage signal terminal S2, and a second electrode of the ninth transistor T9 is connected to the first electrode of the first transistor T1. A gate of the tenth transistor T10 is connected to the enable signal terminal EM, a first electrode of the tenth transistor T10 is connected to the second electrode of the first transistor T1, and a second electrode of the tenth transistor T10 is connected to the second electrode of the element L to be driven.

In the embodiments of the present disclosure, the first electrode of the transistor is one of a source and a drain of the transistor, and the second electrode of the transistor is the other of the source and the drain of the transistor. Since the source and the drain of the transistor may be symmetrical in structure, there may be no difference in structure between the source and the drain of the transistor. That is, there may be no difference in structure between the first electrode and the second electrode of the transistor in the embodiments of the present disclosure. For example, for the P-type transistor, the second electrode is referred to as the drain, and the first electrode is referred to as the source. For another example, for the N-type transistor, the first electrode is referred to as the drain, and the second electrode is referred to as the source.

It will be noted that, except for the driving transistor Td and the first transistor T1, the embodiments of the present disclosure do not limit types of other transistors in the pixel driving circuit, and each of these transistors may be P-type transistors or N-type transistors.

In addition, transistors may be classified into enhancement transistors and depletion transistors according to different conduction modes of the transistors. Each transistor in the embodiments of the present disclosure may be the enhancement transistor or the depletion transistor, which is not limited herein.

In some embodiments, as shown in FIGS. 5 and 7, the driving transistor Td is the P-type transistor, and the first transistor T1 is the N-type transistor.

In a case where the first power supply voltage signal from the first power supply voltage signal terminal S1 is a high-level signal, and the second power supply voltage signal provided from the second power supply voltage signal terminal S2 is a low-level signal, the first electrode of the element L to be driven is an anode, and the second electrode is a cathode. Therefore, in an operating state of the element L to be driven, the driving current flows from the first electrode of the element L to be driven to the second electrode thereof.

Since the driving transistor Td is the P-type transistor, the first electrode of the driving transistor Td is referred to as the source. In this way, the expression "the first power supply voltage signal from the first power supply voltage signal terminal S1 being transmitted to the first electrode of the driving transistor Td" means that, the source of the driving transistor Td receives the first power supply voltage signal.

Since the first transistor T1 is the N-type transistor, the second electrode of the first transistor T1 is referred to as the source. Here, since there may be no difference in structure between the first electrode and the second electrode of the transistor, the second electrode of the first transistor T1 may be understood as the first electrode of the first transistor T1, and correspondingly, the first electrode of the first transistor T1 may be understood as the second electrode of the first transistor T1. In this way, the expression "the second power supply voltage signal from the second power supply voltage signal terminal S2 being transmitted to the first electrode of the first transistor T1" means that the second electrode (i.e., the source) of the first transistor T1 receives the second power supply voltage signal.

On this basis, since the first power supply voltage signal and the second power supply voltage signal are both constant voltage signals, the source of the driving transistor Td and the source of the first transistor T1 are controlled at the constant voltage signal. Therefore, it may be possible to perform finer control on the operation of the element L to be driven, so as to prevent a turn-on voltage of the element L to be driven from affecting the display effect of the display panel.

Figure 10:
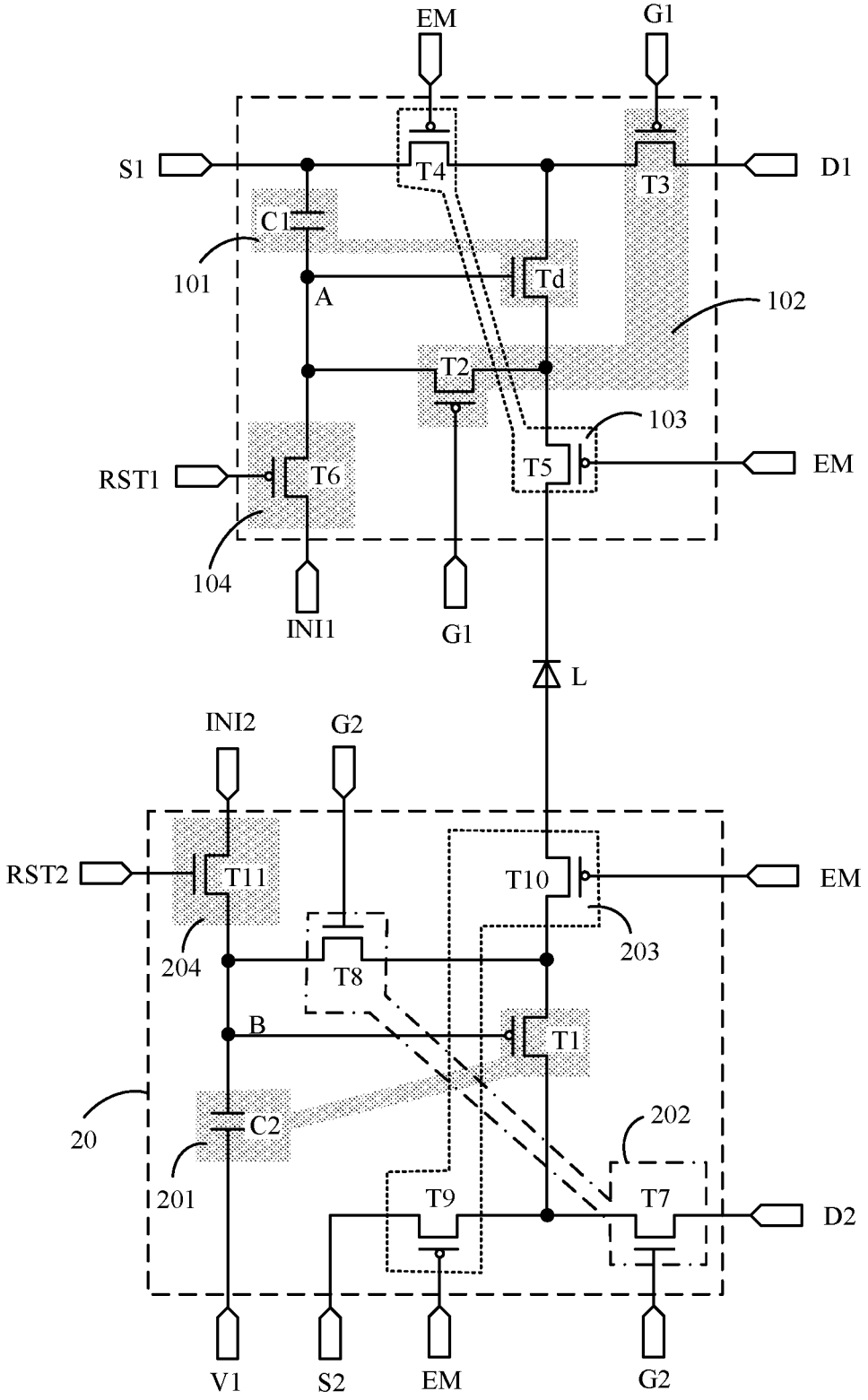
FIG. 10 is a circuit diagram of yet another pixel driving circuit, in accordance with some embodiments.

In some other embodiments, referring to FIG. 10, the driving transistor Td is the N-type transistor, and the first transistor T1 is the P-type transistor.

In a case where the first power supply voltage signal from the first power supply voltage signal terminal S1 is a low-level signal, and the second power supply voltage signal from the second power supply voltage signal terminal S2 is a high-level signal, the first electrode of the element L to be driven is a cathode, and the second electrode is an anode. Therefore, in the operating state of the element L to be driven, the driving current flows from the second electrode of the element L to be driven to the first electrode thereof.

Since the driving transistor Td is the N-type transistor, the second electrode of the driving transistor Td is the source. Here, since there may be no difference in structure between the first electrode and the second electrode of the transistor, the second electrode of the driving transistor Td may be understood as the first electrode of the driving transistor Td, and the first electrode of the driving transistor Td may be understood as the second electrode of the driving transistor Td. In this way, the expression "the first power supply voltage signal from the first power supply voltage signal terminal S1 being transmitted to the first electrode of the driving transistor Td" means that the second electrode (i.e., the source) of the driving transistor Td receives the first power supply voltage signal.

Since the first transistor T1 is the P-type transistor, the first electrode of the first transistor T1 is referred to as the source, and the expression "the second power supply voltage signal from the second power supply voltage signal terminal S2 being to transmitted to the first electrode of the first transistor T1" means that the source of the first transistor T1 receives the second power supply voltage signal.

On this basis, since the first power supply voltage signal and the second power supply voltage signal are both constant voltage signals, the source of the driving transistor Td and the source of the first transistor T1 are controlled at the constant voltage signal. Therefore, it may be possible to perform finer control on the operation of the element L to be driven, so as to prevent the turn-on voltage of the element L to be driven from affecting the display effect of the display panel.

In some embodiments, as shown in FIG. 6, the time control sub-circuit 20 further includes a second reset sub-circuit 204. The second reset sub-circuit 204 is connected to a second initial signal terminal INI2, a second reset signal terminal RST2, and the second node B. The second reset sub-circuit 204 is configured to transmit a second initial signal from the second initial signal terminal INI2 to the second node B in response to a second reset signal from the second reset signal terminal RST2, so as to reset a voltage of the second node B.

Since the first electrode of the second capacitor C2 and the gate of the first transistor T1 are both connected to the second node B, when the second reset sub-circuit 204 resets the second node B, the first electrode of the second capacitor C2 and the gate of the first transistor T1 are both reset at the same time, thereby achieving noise reduction of the second driving sub-circuit 201.

In some embodiments, as shown in FIG. 7, the second reset sub-circuit 204 includes an eleventh transistor T11. A gate of the eleventh transistor T11 is connected to the second reset signal terminal RST2, a first electrode of the eleventh transistor T11 is connected to the second initial signal terminal INI2, and a second electrode of the eleventh transistor T11 is connected to the second node B.

Figure 8:
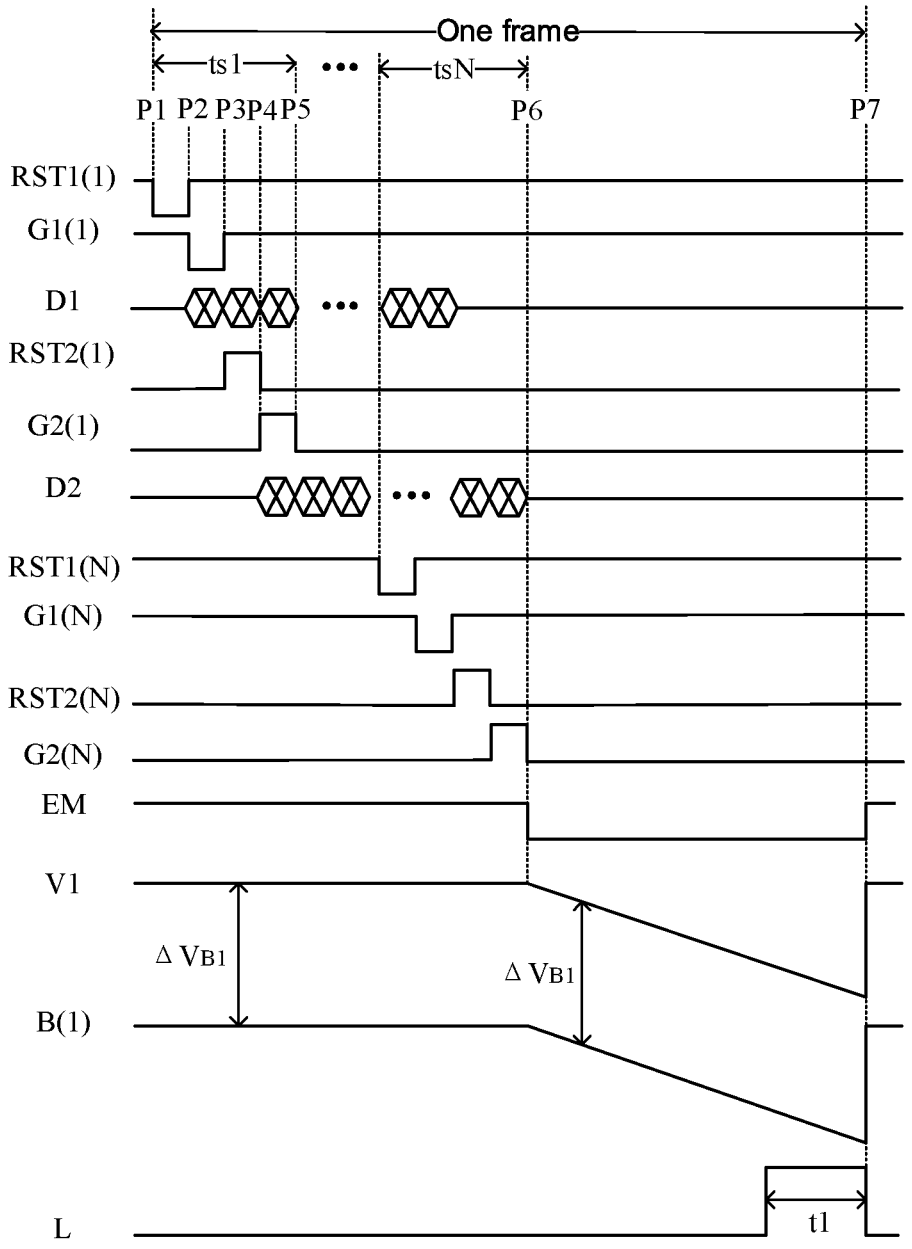
FIG. 8 is a signal timing diagram of a pixel driving circuit, in accordance with some embodiments.

Based on the above, an operating process of the pixel driving circuit shown in FIG. 7 in different periods are illustrated with reference to FIG. 8 (FIG. 8 shows a signal timing diagram of the pixel driving circuit shown in FIG. 7). FIG. 7 is illustrated by taking an example in which transistors in the driving control sub-circuit 10 are all P-type transistors, the first transistor T1, the seventh transistor T7, the eighth transistor T8 and the eleventh transistor T11 in the time control sub-circuit 20 are N-type transistors, and the other transistors in the time control sub-circuit 20 are all P-type transistors.

On this basis, the first power supply voltage signal from the first power supply voltage signal terminal S1 is a high-level signal, and the second power supply voltage signal from the second power supply voltage signal terminal S2 is a low-level signal. The first electrode of the element L to be driven is an anode, and the second electrode of the element L to be driven is a cathode.

As shown in FIG. 8, a frame period includes a scanning phase (P1 to P6) and an operating phase (P6 to P7). The scanning phase (P1 to P6) includes a plurality of row scanning periods. In a case where the plurality of pixel driving circuits in the display panel are arranged in the sub-pixel regions P of N rows and M columns, the plurality of row scanning periods are N row scanning periods. The N row scanning periods are ts1 to tsN. The first row scanning period is ts1, the N-th row scanning period is tsN, and N is an integer not less than two.

In the scanning phase (P1 to P6), the pixel driving circuits in the rows of sub-pixel regions P are scanned row by row. That is, from pixel driving circuits located in the first row of sub-pixel regions P, first data signals and second data signals are input to the pixel driving circuits in the rows of sub-pixel regions P in sequence, until the first data signal and the second data signal are input to pixel driving circuits located in the N-th row of sub-pixel regions P.

In some embodiments, after scanning the pixel driving circuits in the rows of sub-pixel regions P row by row, the operating phase (P6 to P7) is started.

In some examples, the pixel driving circuits in the rows of sub-pixel regions P may enter the operating phase in sequence. That is, the pixel driving circuits in the first row of sub-pixel regions P first enter the operating phase, then pixel driving circuits in the second row of sub-pixel regions P enter the operating phase, and finally the pixel driving circuits in the N-th row of sub-pixel regions P enter the operating phase. Effective duration of the enable signal input to the pixel driving circuits in each row of sub-pixel regions P in the operating phase is the same.

In some other examples, the pixel driving circuits in the rows of sub-pixel regions P enter the operating phase synchronously.

In some other embodiments, the pixel driving circuits in each row of sub-pixel regions P enter the operating phase after a corresponding row scanning period is finished.

In each row scanning period, the pixel driving circuits located in M sub-pixel regions P in the same row are synchronously written with different or the same first data signals. That is to say, the first data signals are a group of signals. The pixel driving circuits located in the M sub-pixel regions P in the same row are synchronously written with different or the same second data signals. That is to say, the second data signals are a group of signals.

The following description will be made by taking an example in which the pixel driving circuit is located in a first sub-pixel region P in the first row, and the element L to be driven connected to the pixel driving circuit is the current mode light-emitting diode.

As shown in FIGS. 7 and 8, in the first row scanning period ts1 of the scanning phase (P1 to P6), the pixel driving circuit located in the first sub-pixel region P in the first row performs the following driving process.

In a first period (P1 to P2), the sixth transistor T6 is turned on in response to the first reset signal received from the first reset signal terminal RST1, and transmits the first initial signal from the first initial signal terminal INI1 to the first node A, so as to reset a voltage of the first node A. In this case, the voltage of the first node A is a voltage (denoted as $V_{init1}$) of the first initial signal. In this case, voltages of the second electrode of the first capacitor C1 and the gate of the driving transistor Td that are connected to the first node A are also reset to $V_{init1}$.

The first initial signal from the first initial signal terminal INI1 may eliminate an influence of a signal of a previous frame on the first node A.

In some examples, the first initial signal is a high-level signal. When the first reset sub-circuit 104 is operating, the first initial signal resets the first node A, so as to ensure that the driving transistor Td is in an off state.

In addition, since the second reset signal from the second reset signal terminal RST2 and the second scanning signal from the second scanning signal terminal G2 are both low-level signals in the first period (P1 to P2), the seventh transistor T7, the eighth transistor T8 and the eleventh transistor T11 are all in the off state. Moreover, since the first scanning signal from the first scanning signal terminal G1 and the enable signal from the enable signal terminal EM are both high-level signals in the first period (P1 to P2), the second transistor T2, the third transistor T3, the fourth transistor T4, the fifth transistor T5, the ninth transistor T9, and the tenth transistor T10 are all in the off state. Therefore, the element L to be driven does not operate.

In a second period (P2 to P3), the second transistor T2 is turned on in response to the first scanning signal received from the first scanning signal terminal G1, so that the gate of the driving transistor Td and the second electrode of the driving transistor Td are short-circuited. In this way, the driving transistor Td is in a saturated state. A voltage of the gate of the driving transistor Td is a sum of a voltage of the first electrode of the driving transistor Td and the threshold voltage of the driving transistor Td.

The third transistor T3 is turned on in response to the first scanning signal received from the first scanning signal terminal G1, and writes the first data signal from the first data signal terminal D1 into the first electrode of the driving transistor Td. Therefore, the voltage of the first electrode of the driving transistor Td is the voltage (denoted as $V_{data1}$) of the first data signal from the first data signal terminal D1. In this case, the voltage of the gate of the driving transistor Td is the sum of the voltage $V_{data1}$ of the first data signal and the threshold voltage (denoted as $V_{thd}$) of the driving transistor Td, i.e., ($V_{data1}+V_{thd}$). The voltage of the first node A connected to the gate of the driving transistor Td is also ($V_{data1}+V_{thd}$).

On this basis, a voltage of the second electrode, connected to the first node A, of the first capacitor C1, is ($V_{data1}+V_{thd}$). Since the first electrode of the first capacitor C1 is connected to the first power supply voltage signal terminal S1, a voltage of the first electrode of the first capacitor C1 is the voltage (denoted as $V_{S1}$) of the first power supply voltage signal. The two electrodes of the first capacitor C1 are charged, and a voltage difference therebetween is ($V_{S1}-V_{data1}-V_{thd}$).

The enable signal from the enable signal terminal EM is the high-level signal in the second period (P2 to P3), and the fifth transistor T5 is still in the off state. Therefore, the element L to be driven and the driving transistor Td are disconnected, and the element L to be driven does not operate. Of course, the fourth transistor T4, the ninth transistor T9, and the tenth transistor T10 are also in the off state.

In addition, the first reset signal is a high-level signal in the second period (P2 to P3), and thus the sixth transistor T6 is in the off state. Moreover, the second reset signal and the second scanning signal are both low-level signals in the second period (P2 to P3), and thus the seventh transistor T7, the eighth transistor T8 and the eleventh transistor T11 are all in the off state.

In a third period (P3 to P4), the eleventh transistor T11 is turned on in response to the second reset signal received from the second reset signal terminal RST2, and transmits the second initial signal from the second initial signal terminal INI2 to the second node B, so as to reset a voltage of the second node B. In this case, the voltage of the second node B is a voltage (denoted as $V_{init2}$) of the second initial signal. Voltages of the first electrode of the second capacitor C2 and the gate of the first transistor T1 that are connected to the second node B are also reset to $V_{init2}$.

The second initial signal provided by the second initial signal terminal INI2 may eliminate an influence of a signal of the previous frame on the second node B.

In some examples, the second initial signal is a low-level signal. When the second reset sub-circuit 204 operates, the second reset sub-circuit 204 resets the second node B to ensure that the first transistor T1 is in the off state.

In addition, the second scanning signal is a low level signal in the third period (P3 to P4), and thus the seventh transistor T7 and the eighth transistor T8 are both in the off state. Moreover, since the first scanning signal, the first reset signal, and the enable signal are all high-level signals in the third period (P3 to P4), the second transistor T2, the third transistor T3, the fourth transistor T4, the fifth transistor T5, and the sixth transistor T6 are all in the off state. In this case, the element L to be driven does not operate.

In a fourth period (P4 to P5), the seventh transistor T7 is turned on in response to the second scanning signal received from the second scanning signal terminal G2, and transmits the second data signal from the second data signal terminal D2 to the first electrode of the first transistor T1. In this case, a voltage of the first electrode of the first transistor T1 is the voltage (denoted as $V_{data2}$) of the second data signal.

Moreover, the eighth transistor T8 is turned on in response to the second scanning signal received from the second scanning signal terminal G2, so that the gate of the first transistor T1 and the second electrode of the first transistor T1 are short-circuited. In this way, the first transistor T1 is in a saturated state. A voltage of the gate of the first transistor T1 is a sum of the voltage of the first electrode of the first transistor T1 and the threshold voltage of the first transistor T1. That is, the voltage of the gate of the first transistor T1 is a sum of the voltage $V_{data2}$ of the second data signal and the threshold voltage (denoted as $V_{th1}$) of the first transistor T1, i.e., ($V_{data2}+V_{th1}$). Correspondingly, the voltage of the second node B connected to the gate of the first transistor T1 is also ($V_{data2}+V_{th1}$).

In this case, the voltage of the first electrode, connected to the second node B, of the second capacitor C2, is also ($V_{data2}+V_{th1}$). Moreover, since the second electrode of the second capacitor C2 is connected to the common voltage signal terminal V1, the voltage of the second electrode of the second capacitor C2 is the voltage $V_{V1}$ of the common voltage signal from the common voltage signal terminal V1. That is, the two electrodes of the second capacitor C2 are charged, and a voltage difference therebetween is ($V_{data2}+V_{th1}-V_{V1}$).

In addition, since the first scanning signal, the first reset signal, and the enable signal are all high-level signals in the fourth period (P4 to P5), the second transistor T2, the third transistor T3, the fourth transistor T4, the fifth transistor T5, the sixth transistor T6, the ninth transistor T9 and the tenth transistor T10 are all in the off state. The second reset signal is a low-level signal in the fourth period (P4 to P5), and thus the eleventh transistor T11 is in the off state. In this case, the element L to be driven does not operate.

It will be noted that, without considering possible signal interferences between the signals, in some embodiments of the present disclosure, the first period (P1 to P2) and the third period (P3 to P4) can be performed simultaneously; and in some other embodiments, the second period (P2 to P3) and the fourth period (P4 to P5) can be performed simultaneously.

Based on the above, since the element L to be driven may exhibit a capacitor characteristic when it is not operating, when the fourth transistor T4, the fifth transistor T5, the ninth transistor T9 and the tenth transistor T10 are all in the off state in the second period (P2 to P3) and the fourth period (P4 to P5), it may be possible to avoid charging the element L to be driven in a process of charging the first capacitor C1 and the second capacitor C2, thereby preventing the element L to be driven from affecting the data writing and the threshold compensation of the pixel driving circuit.

After the first row scanning period ts1 is finished, the pixel driving circuits in the second row of sub-pixel regions P are scanned in the second row scanning period ts2, and so on until the pixel driving circuits in the N-th row of sub-pixel regions P are scanned in the N-th row scanning period tsN. As shown in FIG. 8, starting from an end moment (P5) of the first row scanning period ts1, within the period P5 to P6, pixel driving circuits located in the second row to the N-th row of sub-pixel regions P are scanned row by row.

In respective row scanning periods, driving processes of the pixel driving circuits located in the second row of sub-pixel regions P to the N-th row of sub-pixel regions P are consistent with the driving process of the pixel driving circuits located in the first row of sub-pixel regions P in the first row scanning period ts1, which will not be repeated here. That is, in the entire scanning phase (P1 to P6), the driving process of the first period to the fourth period need to be performed N times.

In summary, in the entire scanning phase (P1 to P6), each of the N row scanning periods includes the first period to the fourth period. Therefore, the first data signals and the second data signals are written into the pixel driving circuits in the N rows of sub-pixel regions P and stored, so as to be prepared for the operating phase (P6 to P7).

In some examples, after scanning the pixel driving circuits in the N rows of sub-pixel regions row by row, the pixel driving circuits in the rows of sub-pixel regions P enter the operating phase (P6 to P7).

In the operating phase (P6 to P7), the operating phase of the pixel driving circuit located in the first sub-pixel region P in the first row includes the following process.

Referring to FIGS. 7 and 8, in the driving control sub-circuit 10, the fourth transistor T4 and the fifth transistor T5 are turned on in response to the enable signal received from the enable signal terminal EM. The first power supply voltage signal from the first power supply voltage signal terminal S1 is transmitted to the first electrode of the driving transistor Td through the fourth transistor T4. In this case, the voltage of the first electrode of the driving transistor Td is the voltage (denoted as $V_{S1}$) of the first power supply voltage signal. That is, a voltage of the source of the driving transistor Td is $V_{S1}$.

According to the law of conservation of charge, a voltage difference between the first electrode and the second electrode of the first capacitor C1 remains unchanged. Therefore, in a case where the voltage of the first electrode of the first capacitor C1 is maintained at the voltage $V_{S1}$ of the first power supply voltage signal, the voltage of the second electrode of the first capacitor C1 is still ($V_{data1}+V_{thd}$). As a result, the voltage of the gate of the driving transistor Td is still maintained at ($V_{data1}+V_{thd}$).

In this case, a gate-source voltage difference $V_{gs}$ of the driving transistor Td is equal to ($V_{data1}+V_{thd}-V_{S1}$) (i.e., $V_{gs}=V_{data1}+V_{thd}-V_{S1}$). The driving transistor Td is turned on when the gate-source voltage difference $V_{gs}$ of the driving transistor Td is less than the threshold voltage of the driving transistor Td. That is, when ($V_{data1}+V_{thd}-V_{S1}$) is less than $V_{thd}$ (i.e., $V_{data1}+V_{thd}-V_{S1}<V_{thd}$), the driving transistor Td is turned on and outputs the driving current. The driving current is output from the second electrode of the driving transistor Td and transmitted to the element L to be driven through the turned-on fifth transistor T5.

The driving current output from the driving transistor Td is: $I=K\times(V_{gs}-V_{thd})^2=K\times(V_{data1}+V_{thd}-V_{S1}-V_{thd})^2=K\times(V_{data1}-V_{S1})^2$. Here, $K=\frac{1}{2}\times W/L\times C\times u$, W/L is a width-to-length ratio of the driving transistor Td, C is a capacitance of a channel insulating layer, and u is a channel carrier mobility.

It can be seen that, the parameter K is only related to the structure of the driving transistor Td. Therefore, the driving current output from the driving transistor Td is related to the voltage $V_{data1}$ of the first data signal from the first data signal terminal D1 and the voltage $V_{S1}$ of the first power supply voltage signal from the first power supply voltage signal terminal S1, and is irrelated to the threshold voltage $V_{thd}$ of the driving transistor Td.

On this basis, when the elements L to be driven in sub-pixel regions P display different gray scales, the same first power supply voltage signals may be input to pixel driving circuits in the sub-pixel regions P, and the first power supply voltage signal may be set as a constant level signal. Therefore, a magnitude of the driving current output from the driving transistor Td may be controlled by controlling the voltage $V_{data1}$ of the first data signal. That is, the magnitude of the driving signal output from the driving transistor Td to the element L to be driven may be controlled by controlling the voltage $V_{data1}$ of the first data signal.

Referring to FIGS. 7 and 8, in the time control sub-circuit 20, the ninth transistor T9 and the tenth transistor T10 are turned on in response to the enable signal received from the enable signal terminal EM. The second power supply voltage signal from the second power supply voltage signal terminal S2 is transmitted to the first electrode of the first transistor T1 through the turned-on ninth transistor T9, so that the voltage of the first electrode of the first transistor T1 is the voltage (denoted as $V_{S2}$) of the second power supply voltage signal.

Since the voltage $V_{V1}$ of the common voltage signal varies within the set voltage range, the voltage of the second electrode of the second capacitor C2 connected to the common voltage signal terminal V1 varies with the voltage $V_{V1}$ of the common voltage signal. According to the law of conservation of charge, the voltage difference between the first electrode and the second electrode of the second capacitor C2 remains unchanged. Therefore, the voltage of the second node B connected to the first electrode of the second capacitor C2 also varies with the voltage $V_{V1}$ of the common voltage signal, and variation speeds of the voltage of the second node B and the voltage of the common voltage signal are the same.

At a start moment of the operating phase (P6 to P7), the voltage of the common voltage signal is denoted as $V_{V1}(0)$, and the voltage of the second node B is denoted as $V_B(0)$. At a t moment of the operating phase (P6 to P7), the voltage of the common voltage signal is denoted as $V_{V1}(t)$, and the voltage of the second node B is denoted as $V_B(t)$. According to the law of conservation of charge, the voltage difference between the two electrodes of the second capacitor C2 remains unchanged. Therefore, a voltage difference ΔV between the second node B and the common voltage signal terminal V1 at the start moment of the operating phase (P6 to P7) and the voltage difference ΔV between the second node B and the common voltage signal terminal V1 at the t moment of the operating phase (P6 to P7) are equal, i.e., $\Delta V=V_B(0)-V_{V1}(0)=V_B(t)-V_{V1}(t)$.

On this basis, at the start moment of the operating phase (P6 to P7), i.e., at an end moment of the fourth period (P4 to P5) of the scanning phase, the voltage $V_B(0)$ of the second node B is equal to $(V_{data2}+V_{th1})$ (i.e., $V_B(0)=V_{data2}+V_{th1}$). Therefore, the voltage difference ΔV between the second node B and the first voltage signal terminal V1 is equal to $(V_{data2}+V_{th1}-V_{V1}(0))$, and is equal to $(V_B(t)-V_{V1}(t))$ (i.e., $\Delta V=V_{data2}+V_{th1}-V_{V1}(0)=V_B(t)-V_{V1}(t)$). At the t moment of the operating phase (P6 to P7), the voltage $V_B(t)$ of the second node B is equal to $(V_{data2}+V_{th1}+V_{V1}(t)-V_{V1}(0))$, and is further equal to $(V_{data2}+V_{th1}+\Delta V_{V1})$ (i.e., $V_B(t)=V_{data2}+V_{th1}+V_{V1}(t)-V_{V1}(0)=V_{data2}+V_{th1}+\Delta V_{V1}$). Here, $\Delta V_{V1}$ is a voltage difference between the voltage $V_{V1}$ of the common voltage signal at the t moment of the operating phase (P6 to P7) and the voltage $V_{V1}$ of the common voltage signal at the start moment of the operating phase (P6 to P7).

Therefore, at the t moment of the operating phase (P6 to P7), the voltage of the gate of the first transistor T1 connected to the second node B is $(V_{data2}+V_{th1}+\Delta V_{V1})$. Moreover, variation speeds of the voltage of the second node B and the voltage of the gate of the first transistor T1 are determined by the common voltage signal.

On this basis, since the first electrode of the first transistor T1 may be understood as the second electrode of the first transistor T1. That is, the first electrode of the first transistor T1 may be referred to as the source, and a voltage of the source of the first transistor T1 is $V_{S2}$. Therefore, when a gate-source voltage difference of the first transistor T1 is greater than the threshold voltage thereof, the first transistor T1 is turned on; and when the gate-source voltage difference of the first transistor T1 is equal to the threshold voltage thereof, the first transistor T1 is in a critical state between on and off, that is, the gate-source voltage difference $V_{gs1}$ of the first transistor T1 is equal to $(V_{data2}+V_{th1}+\Delta V_{V1}-V_{S2})$, and is equal to $V_{th1}$ (i.e., $V_{gs1}=V_{data2}+V_{th1}+\Delta V_{V1}-V_{S2}=V_{th1}$). Therefore, when a voltage difference between the voltages $V_{V1}$ of the common voltage signal that varies within the set voltage range received from the common voltage signal terminal V1 at the start moment and the t moment of the operating phase (P6 to P7) is: $\Delta V_{V1}=V_{S2}-V_{data2}$, the first transistor T1 is turned on. It can be seen that the turn-on of the first transistor T1 is irrelated to the threshold voltage $V_{th1}$ of the first transistor T1.

Since the first electrode of the first transistor T1 is connected to the second electrode of the ninth transistor T9, the first electrode of the ninth transistor T9 is connected to the second power supply voltage signal terminal S2, the second electrode of the first transistor T1 is connected to the first electrode of the tenth transistor T10, and the second electrode of the tenth transistor T10 is connected to the second electrode of the element L to be driven, the turn-on ninth transistor T9 causes the first electrode of the first transistor T1 to be connected to the second power supply voltage signal terminal S2, and the turn-on tenth transistor T10 causes the second electrode of the first transistor T1 to be connected to the second electrode of the element L to be driven. The second power supply voltage signal from the second power supply voltage signal terminal S2 is transmitted to the first transistor T1 through the turn-on ninth transistor T9, and is transmitted to the second electrode of the element L to be driven through the turn-on tenth transistor T10.

At an end moment of the operating phase (P6 to P7), since the enable signal from the enable signal terminal EM changes from a low-level signal to a high-level signal, the fourth transistor T4, the fifth transistor T5, the ninth transistor T9 and the tenth transistor T10 change from the on state to the off state. Therefore, the driving transistor Td and the first transistor T1 are disconnected from the element L to be driven, and the element L to be driven stop operating.

When the first power supply voltage signal from the first power supply voltage signal terminal S1 is transmitted to the first electrode of the element L to be driven, and the second power supply voltage signal from the second power supply voltage signal terminal S2 is transmitted to the second electrode of the element L to be driven, the element L to be driven operates. Therefore, the operating duration of the element L to be driven may be controlled by controlling a turn-on time of the first transistor T1.

In addition, the control of operating duration of the element L to be driven is irrelated to the turn-on voltage of the element L to be driven, which may avoid a Mura phenomenon due to uneven display brightness caused by different turn-on voltages of the elements L to be driven in the display panel.

When the element L to be driven displays different gray scales, and the driving signal provided by the driving control sub-circuit 10 to the element L to be driven remains unchanged, by controlling the voltage $V_{data2}$ of the second data signal from the second data signal terminal D2 to be different, the voltage difference $\Delta V_{V1}$ (which is equal to $(V_{S2}-V_{data2})$) of the voltages of the common voltage signal at the start moment and the t moment of the operating phase (P6 to P7) is different, and the voltage $V_B(t)$ (which is equal to $(V_{data2}+V_{th1}+\Delta V_{V1})$) of the second node B at the t moment of the operating phase (P6 to P7) is also different. Therefore, different voltages of second node B causes a moment at which the first transistor T1 is turned on to be different. As a result, a moment at which the second power supply voltage signal from the second power supply voltage signal terminal S2 is transmitted to the second electrode of the element L to be driven is different, and the turn-on time of the element L to be driven is different. In this way, in a case where the magnitude of the driving signal is maintained within a high value range, the element L to be driven may display different gray scales by controlling the turn-on time of the element L to be driven. As a result, the luminous efficiency of the element L to be driven is improved, and low luminous efficiency and high power consumption of the element L to be driven may be avoided when the low gray scale is displayed at low current density.

Figure 9:
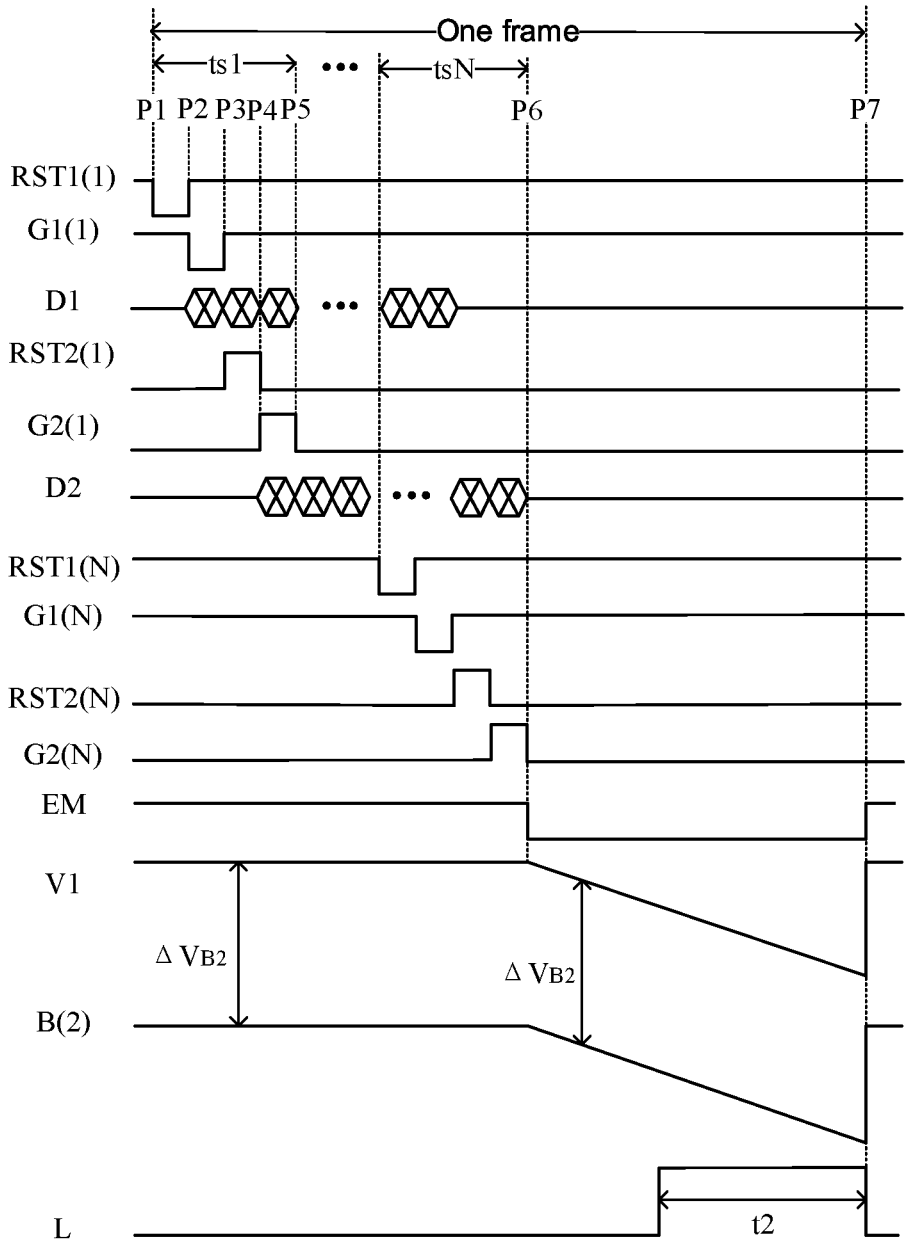
FIG. 9 is a signal timing diagram of another pixel driving circuit, in accordance with some embodiments.

FIGS. 8 and 9 illustrate timing diagrams of the element L to be driven in a same sub-pixel region P when displaying different gray scales. In FIG. 8, B(1) represents a signal timing of the second node B in a frame period, the voltage of the second node B is denoted as $V_{B1}$, $V_{B1}$ changes with the voltage $V_{V1}$ of the common voltage signal by a change amount $\Delta V_{B1}$, and the voltage $V_{B1}$ of the second node B is equal to $(V_{V1}-\Delta V_{B1})$ (i.e., $V_{B1}=V_{V1}-\Delta V_{B1}$). In FIG. 9, B(2) represents a signal timing of the second node B in another frame period, the voltage of the second node B is denoted as $V_{B2}$, $V_{B2}$ changes with the voltage $V_{V1}$ of the common voltage signal by a change amount $\Delta V_{B2}$, and the voltage $V_{B2}$ of the second node is equal to $(V_{V1}-\Delta V_{B2})$ (i.e., $V_{B2}=V_{V1}-\Delta V_{B2}$). In the above two image frame periods, in a case where the voltages $V_{data2}$ of the second data signals from the second data signal terminal D2 are different, a value of $\Delta V_{B2}$ is also different from a value of $\Delta V_{B1}$, and correspondingly, the voltage of the second node B is also different.

In this case, if the value of $\Delta V_{B2}$ is greater than the value of $\Delta V_{B1}$, the time at which the voltage $V_{B2}$ of the second node B changes to turn on the first transistor T1 is earlier than the time at which the voltage $V_{B1}$ of the second node B changes to turn on the first transistor T1. Therefore, the element L to be driven in the frame shown in FIG. 9 is turned on earlier than the element L to be driven in the frame shown in FIG. 8, and the luminous duration of the element L to be driven in the frame shown in FIG. 9 is longer than that of the element L to be driven in the frame shown in FIG. 8.

It will be noted that, for pixel driving circuits in different sub-pixel regions P in the same frame or in different frames, the signal timing of the second node B and a luminous condition of the element L to be driven can also be referred to FIGS. 8 and 9, which will not be repeated here.

Therefore, due to a combination action of the driving control sub-circuit 10 and the time control sub-circuit 20, that is, by controlling the magnitude of the driving current transmitted to the element L to be driven through the driving control sub-circuit 10 and controlling the operating duration of the element L to be driven through the time control sub-circuit 20, the different gray scales displayed by the element L to be driven may be achieved. Moreover, in a case where the magnitude of the driving signal is maintained within the high value range, the element L to be driven may display the low gray scale by shortening the operating duration of the element L to be driven, so as to improve the luminous efficiency of the element L to be driven, and avoid the problems of the low luminous efficiency and the high power consumption of the element L to be driven at the low current density, thereby improving the display effect of the display panel.

It will be noted that, for the driving processes of the pixel driving circuits in the second row to the N-th row of sub-pixel regions P in the operating phase (P6 to P7), reference may be made to the description of the driving process of the pixel driving circuits in the first row of sub-pixel regions P in the operating phase (P6 to P7).

In summary, in the frame period, in the scanning phase (P1 to P6), the first data signal and the second data signal are written into each pixel driving circuit; and in the operating phase (P6 to P7), each pixel driving circuit outputs the driving signal and control the time of the second power supply voltage signal being transmitted to the element L to be driven. In this way, the control of the luminous brightness of the element L to be driven is achieved. On this basis, by controlling the magnitude of the driving current input to the element L to be driven and the luminous duration of the element L to be driven, a luminous intensity of the element L to be driven is changed, thereby achieving the display of different gray scales. For example, by increasing an intensity of the driving signal transmitted to the element L to be driven and controlling the luminous duration of the element L to be driven to be longer, the display of a relatively high gray scale may be achieved. For another example, by controlling turn-on time of the element L to be driven, that is, by controlling the time of the second power supply voltage signal being transmitted to the element L to be driven, the display of a low gray scale may be achieved. In this way, the element L to be driven may operate within a relatively stable current density range, which may avoid a problem of unstable luminescence of the element L to be driven at a low current density. As a result, the luminous efficiency of the element L to be driven is improved, and the power consumption of the display panel is reduced.

In some other embodiments, as shown in FIG. 10, the driving transistor Td, the seventh transistor T7, the eighth transistor T8 and the eleventh transistor T11 are all N-type transistors, and the other transistors are all P-type transistors.

On this basis, the first power supply voltage signal from the first power supply voltage signal terminal S1 is the low-level signal, and the second power supply voltage signal from the second power supply voltage signal terminal S2 is the high-level signal. The first electrode of the element L to be driven is the cathode, and the second electrode of the element L to be driven is the anode.

It will be noted that, the pixel driving circuit shown in FIG. 10 has the same operating process as the pixel driving circuit shown in FIG. 7 in different phases, and the both have the same technical effect, which will not be repeated here.

Some embodiments of the present disclosure provide a driving method for the pixel driving circuit. As shown in FIG. 8, a frame period includes a scanning phase (P1 to P6) and an operating phase (P6 to P7). The scanning phase (P1 to P6) includes a plurality of row scanning periods (ts1 to tsN). The driving method includes steps 10 and 20 (S10 and S20) in each row scanning period and steps 30 and 40 (S30 and S40) in the operating phase.

Referring to FIGS. 2 and 8, the driving method is as follows.

In S10, the driving control sub-circuit 10 writes at least the first data signal from the first data signal terminal D1 into the first driving sub-circuit 101, in response to the first scanning signal received from the first scanning signal terminal G1.

In S20, the time control sub-circuit 20 writes at least the second data signal from the second data signal terminal D2 into the second driving sub-circuit, in response to the second scanning signal received from the second scanning signal terminal G2.

In S30, the driving control sub-circuit 10 causes the driving transistor Td included in the first driving sub-circuit 101 to output the driving signal to the first electrode of the element L to be driven according to the first data signal from the first data signal terminal D1 and the first power supply voltage signal from the first power supply voltage signal terminal S1, in response to the enable signal received from the enable signal terminal EM.

In S40, the time control sub-circuit 20 causes the second driving sub-circuit 201 to be connected to the second power supply voltage signal terminal S2 and the second electrode of the element L to be driven, in response to the enable signal received from the enable signal terminal EM. The second driving sub-circuit 201 outputs the second power supply voltage signal from the second power supply voltage signal terminal S2 to the second electrode of the element L to be driven in response to the second data signal from the second data signal terminal D2 and the common voltage signal that varies within the set voltage range received from the common voltage signal terminal V1, so that the element L to be driven operates in response to the received driving signal and the second power supply voltage signal.

In some embodiments, referring to FIGS. 4 and 5, the driving control sub-circuit 10 includes the first driving sub-circuit 101, the first data writing sub-circuit 102 and the first control sub-circuit 103.

Referring to FIGS. 4, 5 and 8, S10 includes S101, and S30 includes S301.

In S101, the first data writing sub-circuit 102 writes the first data signal from the first data signal terminal D1 and the threshold voltage of the driving transistor Td into the first node A in response to the first scanning signal received from the first scanning signal terminal G1, so as to compensate for the threshold voltage of the driving transistor Td.

In S301, the first control sub-circuit 103 connects the driving transistor Td to the first power supply voltage signal terminal S1 and the first electrode of the element L to be driven in response to the enable signal received from the enable signal terminal EM, so that the driving transistor Td outputs the driving signal to the first electrode of the element L to be driven according to the first data signal from the first data signal terminal D1 and the first power supply voltage signal from the first power supply voltage signal terminal S1.

In some embodiments, referring to FIGS. 4 and 5, the time control sub-circuit 20 includes the second driving sub-circuit 201, the second data writing sub-circuit 202 and the second control sub-circuit 203.

Referring to FIGS. 4, 5, and 8, S20 includes S201, and S40 includes S401.

In S201, the second data writing sub-circuit 202 writes the second data signal from the second data signal terminal D2 and the threshold voltage of the first transistor T1 in the second driving sub-circuit 201 into the second node B in response to the second scanning signal received from the second scanning signal terminal G2, so as to compensate for the threshold voltage of the first transistor T1.

In S401, the second control sub-circuit 203 connects the first transistor T1 to the second power supply voltage signal terminal S2 and the second electrode of the element L to be driven in response to the enable signal received from the enable signal terminal EM, so that the first transistor T1 is turned on in response to the common voltage signal that varies within the set voltage range received from the common voltage signal terminal V1 and the second data signal from the second data signal terminal D2, and transmits the second power supply voltage signal from the second power supply voltage signal terminal S2 to the second electrode of the element L to be driven.

The beneficial effect of the driving method for the pixel driving circuit is the same as the beneficial effect of the pixel driving circuit, which will not be repeated here.

In some embodiments, referring to FIGS. 6 and 7, the driving control sub-circuit 10 further includes the first reset sub-circuit 104.

In each of the plurality of row scanning periods, referring to FIGS. 6 to 8, S10 further includes S102.

In S102, the first reset sub-circuit 104 transmits the first initial signal from the first initial signal terminal INI1 to the first node A in response to the first reset signal received from the first reset signal terminal RST1, so as to reset the voltage of the first node A.

For example, as shown in FIGS. 7 and 8, the first reset sub-circuit 104 includes the sixth transistor T6. The sixth transistor T6 is turned on in response to the first reset signal received from the first reset signal terminal RST1, and transmit the first initial signal from the first initial signal terminal INI1 to the first node A, so as to reset the voltage of the first node A. Therefore, the voltage of the first node A is the voltage $V_{init1}$ of the first initial signal. In this case, the voltages of the second electrode of the first capacitor C1 and the gate of the driving transistor Td that are connected to the first node A are also reset.

In some embodiments, as shown in FIGS. 6 and 7, the time control sub-circuit 20 further includes the second reset sub-circuit 204.

In each of the plurality of row scanning periods, referring to FIGS. 6 and 8, S20 further includes S202.

In S202, the second reset sub-circuit 204 transmits the second initial signal from the second initial signal terminal INI2 to the second node B in response to the second reset signal received from the second reset signal terminal RST2, so as to reset the voltage of the second node B.

For example, as shown in FIGS. 7 and 8, the second reset sub-circuit 204 includes the eleventh transistor T11. The eleventh transistor T11 is turned on in response to the second reset signal received from the second reset signal terminal RST2, and transmit the second initial signal from the second initial signal terminal INI2 to the second node B, so as to reset the voltage of the second node B. Therefore, the voltage of the second node B is the voltage $V_{init2}$ of the second initial signal. In this case, the voltages of the first electrode of the second capacitor C2 and the gate of the first transistor T1 that are connected to the second node B are also reset.

In each row scanning period, the first reset sub-circuit 104 resets a voltage of the first driving sub-circuit 101, and the second reset sub-circuit 204 resets a voltage of the second driving sub-circuit 201, thereby achieving the noise reduction of the first driving sub-circuit 101 and the second driving sub-circuit 201, and avoiding affecting the first data signals and the second data signals written in the subsequent driving process.

Based on the above, in some embodiments, referring to FIG. 1, the display panel further includes a plurality of first scanning signal lines G1(1) to G1(N), a plurality of first data signal lines D1(1) to D1(M), a plurality of second scanning signal lines G2(1) to G2(N), a plurality of second data signal lines D2(1) to D2(M), a plurality of enable signal lines E(1) to E(N), a plurality of first power supply voltage signal lines $L_{S1}$, a plurality of second power supply voltage signal lines $L_{S2}$, and a plurality of common voltage signal lines $L_{V1}$. The first scanning signal line is configured to provide the first scanning signal to the pixel driving circuit. The second scanning signal line is configured to provide the second scanning signal to the pixel driving circuit. The enable signal line is configured to provide the enable signal to the pixel driving circuit. The first data signal line is configured to provide the first data signal to the pixel driving circuit. The second data signal line is configured to provide the second data signal to the pixel driving circuit. The first power supply voltage signal line is configured to provide the first power supply voltage signal to the pixel driving circuit. The second power supply voltage signal line is configured to provide the second power supply voltage signal to the pixel driving circuit. The common voltage signal line is configured to provide the common voltage signal to the pixel driving circuit.

In some examples, pixel driving circuits located in a same row of sub-pixel regions P are connected to a same first scanning signal line in the plurality of first scanning signal lines G1(1) to G1(N), a same second scanning signal line in the plurality of second scanning signal lines G2(1) to G2(N), and a same enable signal line in the plurality of enable signal lines E(1) to E(N); and pixel driving circuits located in a same column of sub-pixel regions P are connected to a same first data signal line in the plurality of first data signal lines D1(1) to D1 (M), a same second data signal line in the plurality of second data signal lines D2(1) to D2(M), a same first power supply voltage signal line in the plurality of first power supply voltage signal lines $L_{S1}$, a same second power supply voltage signal line in the plurality of second power supply voltage signal lines $L_{S2}$, and a same common voltage signal line in the plurality of common voltage signal lines $L_{V1}$.

For example, as shown in FIG. 1, pixel driving circuits located in the first row of sub-pixel regions P are connected to the first scanning signal line G1(1), the second scanning signal line G2(1), and the enable signal line E(1); pixel driving circuits located in the second row of sub-pixel regions P are connected to the first scanning signal line G1(2), the second scanning signal line G2(2) and the enable signal line E(2); and pixel driving circuits located in the N-th row of sub-pixel regions P are connected to the first scanning signal line G1(N), the second scanning signal line G2(N) and the enable signal line E(N). Pixel driving circuits located in the first column of sub-pixel regions P are connected to the first data signal line D1(1), the second data signal line D2(1), the first power supply voltage signal line $L_{S1}$, the second power supply voltage signal line $L_{S2}$ and the common voltage signal line $L_{V1}$; pixel driving circuits located in the second column of sub-pixel regions P are connected to the first data signal line D1(2), the second data signal line D2(2), the first power supply voltage signal line $L_{S1}$, the second power supply voltage signal line $L_{S2}$ and the common voltage signal line $L_{V1}$; and pixel driving circuits located in the M-th column of sub-pixel regions P are connected to the first data signal line D1(M), the second data signal line D2(M), the first power supply voltage signal line $L_{S1}$, the second power supply voltage signal line $L_{S2}$ and the common voltage signal line $L_{V1}$.

On this basis, the first scanning signal terminal G1 may be understood as an equivalent connection point of the first scanning signal line being connected to the pixel driving circuit. The same is true for the second scanning signal terminal G2. The first data signal terminal D1 may be understood as an equivalent connection point of the first data signal line being connected to the pixel driving circuit. The same is true for the second data signal terminal D2. The enable signal terminal EM may be understood as an equivalent connection point of the enable signal line being connected to the pixel driving circuit. The first power supply voltage signal terminal may be understood as an equivalent connection point of the first power supply voltage signal line $L_{S1}$ being connected to the pixel driving circuit. The second power supply voltage signal terminal may be understood as an equivalent connection point of the second power supply voltage signal line $L_{S2}$ being connected to the pixel driving circuit. The common voltage signal terminal V1 may be understood as an equivalent connection point of the common voltage signal line $L_{V1}$ being connected to the pixel driving circuit.

It will be noted that, those skilled in the art may set connection manners in which the pixel driving circuits in the sub-pixel regions P are connected to the first power supply voltage signal lines $L_{S1}$, the second power supply voltage signal lines $L_{S2}$, and the common voltage signal lines $L_{V1}$ according to a spatial structure of the display panel. FIG. 1 is illustrated by taking an example in which pixel driving circuits located in any two columns of sub-pixel regions P are connected to different first power supply voltage signal lines $L_{S1}$, different second power supply voltage signal lines $L_{S2}$, and different common voltage signal lines $L_{V1}$. However, the embodiments of the present disclosure are not limited thereto. It may be possible that pixel driving circuits located in columns (e.g., two, three or four columns) of sub-pixel regions P are connected to a same first power supply voltage signal line $L_{S1}$, a same second power supply voltage signal line $L_{S2}$ and a same common voltage signal line $L_{V1}$.

In some embodiments, as shown in FIG. 1, the display panel further includes a plurality of first reset signal lines R1(1) to R1(N) and a plurality of first initial signal lines (not shown in FIG. 1). The first reset signal line is configured to provide the first reset signal to the pixel driving circuit. The first initial signal line is configured to provide the first initial signal to the pixel driving circuit.

In some examples, the pixel driving circuits located in the same row of sub-pixel regions P are connected to a same first reset signal line in the plurality of first reset signal lines R1(1) to R1(N), and the pixel driving circuits located in the same column of sub-pixel regions P are connected to a same first initial signal line in the plurality of first initial signal lines.

For example, as shown in FIG. 1, the pixel driving circuits located in the first row of sub-pixel regions P are connected to the first reset signal line R1(1), the pixel driving circuits located in the second row of sub-pixel regions P are connected to the first reset signal line R1(2), and the pixel driving circuits located in the N-th row of sub-pixel regions P are connected to the first reset signal line R1(N).

The first reset signal terminal RST1 may be understood as an equivalent connection point of the first reset signal line being connected to the pixel driving circuit. The first initial signal terminal INI1 may be understood as an equivalent connection point of the first initial signal line being connected to the pixel driving circuit.

In some embodiments, as shown in FIG. 1, the display panel further includes a plurality of second reset signal lines R2(1) to R2(N) and a plurality of second initial signal lines (not shown in FIG. 1). The second reset signal line is configured to provide the second reset signal to the pixel driving circuit. The second initial signal line is configured to provide the second initial signal to the pixel driving circuit.

In some examples, the pixel driving circuits located in the same row of sub-pixel regions P are connected to a same second reset signal line in the plurality of second reset signal lines R2(1) to R2(N), and the pixel driving circuits located in the same column of sub-pixel regions P are connected to a same second initial signal line in the plurality of second initial signal lines.

For example, as shown in FIG. 1, the pixel driving circuits located in the first row of sub-pixel regions P are connected to the second reset signal line R2(1); the pixel driving circuits located in the second row of sub-pixel regions P are connected to the second reset signal line R2(2); and the pixel driving circuits located in the N-th row of sub-pixel regions P are connected to the second reset signal line R2(N).

The second reset signal terminal RST2 may be understood as an equivalent connection point of the second reset signal line being connected to the pixel driving circuit. The second initial signal terminal INI2 may be understood as an equivalent connection point of the second initial signal line being connected to the pixel driving circuit.

It will be noted that, arrangements of the plurality of signal lines included in the display panel described in the embodiments and the wiring diagram of the display panel shown in FIG. 1 are only some examples, and the embodiments of the present disclosure are not limited thereto.

The foregoing descriptions are merely specific implementations of the present disclosure, but the protection scope of the present disclosure is not limited thereto. Any person skilled in the art could conceive of changes or replacements within the technical scope of the present disclosure, which shall be included in the protection scope of the present disclosure. Therefore, the protection scope of the present disclosure shall be subject to the protection scope of the claims.

What is claimed is:

1. A pixel driving circuit, comprising:

a driving control sub-circuit connected to at least a first scanning signal terminal, a first data signal terminal, a first power supply voltage signal terminal, an enable signal terminal and a first electrode of a element to be driven, wherein the driving control sub-circuit includes a first driving sub-circuit, and the first driving sub-circuit includes a driving transistor; and the driving control sub-circuit is configured to write at least a first data signal from the first data signal terminal into the first driving sub-circuit in response to a first scanning signal received from the first scanning signal terminal, and cause the driving transistor to output a driving signal to the first electrode of the element to be driven according to the first data signal and a first power supply voltage signal from the first power supply voltage signal terminal in response to an enable signal received from the enable signal terminal; and a time control sub-circuit connected to at least a second scanning signal terminal, a second data signal terminal, a second power supply voltage signal terminal, the enable signal terminal, a common voltage signal terminal, and a second electrode of the element to be driven, wherein the time control sub-circuit includes a second driving sub-circuit; the time control sub-circuit is configured to write at least a second data signal from the second data signal terminal into the second driving sub-circuit in response to a second scanning signal received from the second scanning signal terminal, and cause the second driving sub-circuit to be connected to the second power supply voltage signal terminal and the second electrode of the element to be driven in response to the enable signal received from the enable signal terminal; and the second driving sub-circuit is configured to output a second power supply voltage signal from the second power supply voltage signal terminal to the second electrode of the element to be driven in response to the second data signal and a common voltage signal that varies within a set voltage range received from the common voltage signal terminal, so that the element to be driven operates in response to the received driving signal and the second power supply voltage signal.

2. The pixel driving circuit according to claim 1, wherein the first driving sub-circuit further includes a first capacitor; a first electrode of the first capacitor is connected to the first power supply voltage signal terminal, and a second electrode of the first capacitor is connected to a first node; and a gate of the driving transistor is connected to the first node.

3. The pixel driving circuit according to claim 2, wherein the driving control sub-circuit further includes a first data writing sub-circuit and a first control sub-circuit;

the first data writing sub-circuit is connected to the first scanning signal terminal, the first data signal terminal, the first node and the driving transistor, and the first data writing sub-circuit is configured to write the first data signal and a threshold voltage of the driving transistor into the first node in response to the received first scanning signal; and the first control sub-circuit is connected to the enable signal terminal, the first power supply voltage signal terminal, the driving transistor and the first electrode of the element to be driven, and the first control sub-circuit is configured to connect the driving transistor to the first power supply voltage signal terminal and the first electrode of the element to be driven in response to the received enable signal.

4. The pixel driving circuit according to claim 3, wherein the first data writing sub-circuit includes a second transistor and a third transistor;

a gate of the second transistor is connected to the first scanning signal terminal, a first electrode of the second transistor is connected to a second electrode of the driving transistor, and a second electrode of the second transistor is connected to the first node; and a gate of the third transistor is connected to the first scanning signal terminal, a first electrode of the third transistor is connected to the first data signal terminal, and a second electrode of the third transistor is connected to a first electrode of the driving transistor.

5. The pixel driving circuit according to claim 3, wherein the first control sub-circuit includes a fourth transistor and a fifth transistor;

a gate of the fourth transistor is connected to the enable signal terminal, a first electrode of the fourth transistor is connected to the first power supply voltage signal terminal, and a second electrode of the fourth transistor is connected to a first electrode of the driving transistor; and a gate of the fifth transistor is connected to the enable signal terminal, a first electrode of the fifth transistor is connected to a second electrode of the driving transistor, and a second electrode of the fifth transistor is connected to the first electrode of the element to be driven.

6. The pixel driving circuit according to claim 1, wherein the driving control sub-circuit further includes a first reset sub-circuit; and the first reset sub-circuit is connected to a first initial signal terminal, a first reset signal terminal and a gate of the driving transistor; and the first reset sub-circuit is configured to transmit a first initial signal from the first initial signal terminal to the gate of the driving transistor in response to a first reset signal received from the first reset signal terminal, so as to reset a voltage of the gate of the driving transistor.

7. The pixel driving circuit according to claim 6, wherein the first reset sub-circuit includes a sixth transistor; and a gate of the sixth transistor is connected to the first reset signal terminal, a first electrode of the sixth transistor is connected to the first initial signal terminal, and a second electrode of the sixth transistor is connected to the gate of the driving transistor.

8. The pixel driving circuit according to claim 1, wherein the second driving sub-circuit includes a first transistor and a second capacitor; a first electrode of the second capacitor is connected to a second node, and a second electrode of the second capacitor is connected to the common voltage signal terminal; a gate of the first transistor is connected to the second node; and the first transistor is configured to be turned on in response to the common voltage signal that varies within the set voltage range received from the common voltage signal terminal and the second data signal.

9. The pixel driving circuit according to claim 8, wherein the time control sub-circuit further includes a second data writing sub-circuit and a second control sub-circuit;

the second data writing sub-circuit is connected to the second scanning signal terminal, the second data signal terminal, the second node, and a first electrode and a second electrode of the first transistor, and the second data writing sub-circuit is configured to write the second data signal and a threshold voltage of the first transistor into the second node in response to the received second scanning signal; and the second control sub-circuit is connected to the enable signal terminal, the second power supply voltage signal terminal, the first electrode and the second electrode of the first transistor, and the second electrode of the element to be driven, and the second control sub-circuit is configured to connect the first transistor to the second power supply voltage signal terminal and the second electrode of the element to be driven in response to the received enable signal.

10. The pixel driving circuit according to claim 9, wherein the second data writing sub-circuit includes a seventh transistor and an eighth transistor;

a gate of the seventh transistor is connected to the second scanning signal terminal, a first electrode of the seventh transistor is connected to the second data signal terminal, and a second electrode of the seventh transistor is connected to the first electrode of the first transistor;

a gate of the eighth transistor is connected to the second scanning signal terminal, a first electrode of the eighth transistor is connected to the second electrode of the first transistor, and a second electrode of the eighth transistor is connected to the second node; or the second control sub-circuit includes a ninth transistor and a tenth transistor;

a gate of the ninth transistor is connected to the enable signal terminal, a first electrode of the ninth transistor is connected to the second power supply voltage signal terminal, and a second electrode of the ninth transistor is connected to the first electrode of the first transistor; and a gate of the tenth transistor is connected to the enable signal terminal, a second electrode of the tenth transistor is connected to the second electrode of the element to be driven, and a first electrode of the tenth transistor is connected to the second electrode of the first transistor; or the second data writing sub-circuit includes the seventh transistor and the eighth transistor; the gate of the seventh transistor is connected to the second scanning signal terminal, the first electrode of the seventh transistor is connected to the second data signal terminal, and the second electrode of the seventh transistor is connected to the first electrode of the first transistor; and the gate of the eighth transistor is connected to the second scanning signal terminal, the first electrode of the eighth transistor is connected to the second electrode of the first transistor, and the second electrode of the eighth transistor is connected to the second node; and the second control sub-circuit includes the ninth transistor and the tenth transistor; the gate of the ninth transistor is connected to the enable signal terminal, the first electrode of the ninth transistor is connected to the second power supply voltage signal terminal, and the second electrode of the ninth transistor is connected to the first electrode of the first transistor; and the gate of the tenth transistor is connected to the enable signal terminal, the second electrode of the tenth transistor is connected to the second electrode of the element to be driven, and the first electrode of the tenth transistor is connected to the second electrode of the first transistor.

11. The pixel driving circuit according to claim 10, wherein the first transistor is an N-type transistor, and the driving transistor is a P-type transistor; or the first transistor is a P-type transistor, and the driving transistor is an N-type transistor.

12. The pixel driving circuit according to claim 9, wherein the time control sub-circuit further includes a second reset sub-circuit; and the second reset sub-circuit is connected to a second initial signal terminal, a second reset signal terminal and the second node; and the second reset sub-circuit is configured to transmit a second initial signal from the second initial signal terminal to the second node in response to a second reset signal received from the second reset signal terminal, so as to reset a voltage of the second node.

13. The pixel driving circuit according to claim 12, wherein the second reset sub-circuit includes an eleventh transistor; and a gate of the eleventh transistor is connected to the second reset signal terminal, a first electrode of the eleventh transistor is connected to the second initial signal terminal, and a second electrode of the eleventh transistor is connected to the second node.

14. A display panel, comprising:

a plurality of pixel driving circuits according to claim 1; and a plurality of elements to be driven, and an element to be driven of the plurality of elements to be driven being connected to a corresponding pixel driving circuit.

15. The display panel according to claim 14, wherein the display panel has a plurality of sub-pixel regions, and each pixel driving circuit is disposed in one sub-pixel region; and the display panel further comprises:

a plurality of first scanning signal lines, wherein first scanning signal terminals connected to pixel driving circuits located in the same row of sub-pixel regions are connected to a corresponding first scanning signal line;

a plurality of first data signal lines, wherein first data signal terminals connected to pixel driving circuits located in the same column of sub-pixel regions are connected to a corresponding first data signal line;

a plurality of second scanning signal lines, wherein second scanning signal terminals connected to the pixel driving circuits located in the same row of sub-pixel regions are connected to a corresponding second scanning signal line; and a plurality of second data signal lines, wherein second data signal terminals connected to the pixel driving circuits located in the same column of sub-pixel regions are connected to a corresponding second data signal line.

16. The display panel according to claim 14, wherein the element to be driven is a current mode light-emitting diode.

17. A display apparatus, comprising the display panel according to claim 14.

18. A driving method for the pixel driving circuit according to claim 1, a frame period including a scanning phase and an operating phase, and the scanning phase including a plurality of row scanning periods;

the driving method comprising:

in each of the plurality of row scanning periods:

writing, by the driving control sub-circuit, at least the first data signal from the first data signal terminal into the first driving sub-circuit, in response to the first scanning signal received from the first scanning signal terminal; and writing, by the time control sub-circuit, at least the second data signal from the second data signal terminal into the second driving sub-circuit, in response to the second scanning signal received from the second scanning signal terminal; and in the operating phase:

causing, by the driving control sub-circuit, the driving transistor in the first driving sub-circuit to output the driving signal to the first electrode of the element to be driven according to the first data signal and the first power supply voltage signal from the first power supply voltage signal terminal, in response to the enable signal received from the enable signal terminal;

causing, by the time control sub-circuit, the second driving sub-circuit to be connected to the second power supply voltage signal terminal and the second electrode of the element to be driven, in response to the enable signal received from the enable signal terminal; and outputting, by the second driving sub-circuit, the second power supply voltage signal from the second power supply voltage signal terminal to the second electrode of the element to be driven in response to the second data signal and the common voltage signal that varies within the set voltage range received from the common voltage signal terminal, so that the element to be driven operates in response to the received driving signal and the second power supply voltage signal.

19. The driving method for the pixel driving circuit according to claim 18, wherein the driving control sub-circuit further includes a first data writing sub-circuit and a first control sub-circuit; and in each of the plurality of row scanning periods, writing, by the driving control sub-circuit, at least the first data signal into the first driving sub-circuit in response to the received first scanning signal, and in the operating phase, causing, by the driving control sub-circuit, the driving transistor in the first driving sub-circuit to output the driving signal to the first electrode of the element to be driven according to the first data signal and the first power supply voltage signal in response to the enable signal, includes:

in each of the plurality of row scanning periods:

writing, by the first data writing sub-circuit, the first data signal and a threshold voltage of the driving transistor into the first node, in response to the received first scanning signal; and in the operating phase:

causing, by the first control sub-circuit, the driving transistor to be connected to the first power supply voltage signal terminal and the first electrode of the element to be driven in response to the received enable signal, so that the driving transistor outputs the driving signal to the first electrode of the element to be driven according to the first data signal and the first power supply voltage signal.

20. The driving method for the pixel driving circuit according to claim 18, wherein the time control sub-circuit further includes a second data writing sub-circuit and a second control sub-circuit; and in each of the plurality of row scanning periods, writing, by the time control sub-circuit, at least the second data signal into the second driving sub-circuit in response to the received second scanning signal, and in the operating phase, causing, by the time control sub-circuit, the second driving sub-circuit to be connected to the second power supply voltage signal terminal and the second electrode of the element to be driven in response to the received enable signal, includes:

in each of the plurality of row scanning periods:

writing, by the second data writing sub-circuit, the second data signal and a threshold voltage of the first transistor into a gate of the first transistor, in response to the received second scanning signal; and in the operating phase:

causing, by the second control sub-circuit, the first transistor to be connected to the second power supply voltage signal terminal and the second electrode of the element to be driven, in response to the received enable signal.

* * * * *